US011847976B2

(12) United States Patent
Talebzadeh et al.

(10) Patent No.: US 11,847,976 B2
(45) Date of Patent: Dec. 19, 2023

(54) PIXEL MEASUREMENT THROUGH DATA LINE

(71) Applicant: Ignis Innovation Inc., Waterloo (CA)

(72) Inventors: Jafar Talebzadeh, Waterloo (CA); Ray Leerentveld, Palgrave (CA)

(73) Assignee: Ignis Innovation Inc., Road Town (VG)

( * ) Notice: Subject to any disclaimer, the term of this patent is extended or adjusted under 35 U.S.C. 154(b) by 0 days.

(21) Appl. No.: 17/952,781

(22) Filed: Sep. 26, 2022

(65) Prior Publication Data

US 2023/0008299 A1 Jan. 12, 2023

Related U.S. Application Data

(63) Continuation of application No. 17/205,639, filed on Mar. 18, 2021, now Pat. No. 11,488,541, which is a continuation of application No. 16/028,073, filed on Jul. 5, 2018, now Pat. No. 10,971,078, which is a continuation-in-part of application No. 15/968,134, filed on May 1, 2018, now abandoned.

(60) Provisional application No. 62/629,450, filed on Feb. 12, 2018.

(51) Int. Cl.

| | |
|---|---|
| ***G09G 3/3283*** | (2016.01) |
| ***G09G 3/00*** | (2006.01) |
| ***G09G 3/325*** | (2016.01) |
| ***H05B 45/60*** | (2022.01) |

(52) U.S. Cl.

CPC ..... *G09G 3/3283* (2013.01); *G09G 3/006* (2013.01); *G09G 3/325* (2013.01); *H05B 45/60* (2020.01)

(58) Field of Classification Search

None

See application file for complete search history.

(56) References Cited

U.S. PATENT DOCUMENTS

| | | | |
|---|---|---|---|
| 4,354,162 | A | 10/1982 | Wright |
| 4,758,831 | A | 7/1988 | Kasahara |
| 4,963,860 | A | 10/1990 | Stewart |
| 4,975,691 | A | 12/1990 | Lee |
| 4,996,523 | A | 2/1991 | Bell |
| 5,051,739 | A | 9/1991 | Hayashida |

(Continued)

FOREIGN PATENT DOCUMENTS

| | | |
|---|---|---|
| CA | 1294034 | 1/1992 |
| CA | 2109951 | 11/1992 |

(Continued)

OTHER PUBLICATIONS

Ahnood et al.: "Effect of threshold voltage instability on field effect mobility in thin film transistors deduced from constant current measurements"; dated Aug. 2009 (3 pages).

(Continued)

*Primary Examiner* — Krishna P Neupane

(74) *Attorney, Agent, or Firm* — Stratford Group Ltd.

(57) ABSTRACT

A system and method for determining the current of a pixel circuit and an organic light emitting diode (OLED). The pixel circuit is connected to a source driver by a data line. The voltage (or current) supplied to the pixel circuit by the source driver. The current of the pixel and the OLED can be measured by a readout circuit. A value of a voltage from the measured current can be extracted and provided to a processor for further processing.

20 Claims, 13 Drawing Sheets

(56) References Cited

U.S. PATENT DOCUMENTS 5,222,082 A 6/1993 Plus
5,266,515 A 11/1993 Robb
5,498,880 A 3/1996 Lee
5,589,847 A 12/1996 Lewis
5,619,033 A 4/1997 Weisfield
5,648,276 A 7/1997 Hara
5,670,973 A 9/1997 Bassetti
5,684,365 A 11/1997 Tang
5,686,935 A 11/1997 Weisbrod
5,712,653 A 1/1998 Katoh
5,714,968 A 2/1998 Ikeda
5,747,928 A 5/1998 Shanks
5,748,160 A 5/1998 Shieh
5,784,042 A 7/1998 Ono
5,790,234 A 8/1998 Matsuyama
5,815,303 A 9/1998 Berlin
5,870,071 A 2/1999 Kawahata
5,874,803 A 2/1999 Garbuzov
5,880,582 A 3/1999 Sawada
5,899,461 A 5/1999 Yomogita
5,903,248 A 5/1999 Irwin
5,917,280 A 6/1999 Burrows
5,923,794 A 7/1999 McGrath
5,952,789 A 9/1999 Stewart
5,990,629 A 11/1999 Yamada
6,023,259 A 2/2000 Howard
6,069,365 A 5/2000 Chow
6,081,131 A 6/2000 Ishii
6,091,203 A 7/2000 Kawashima
6,097,360 A 8/2000 Holloman
6,144,222 A 11/2000 Ho
6,157,583 A 12/2000 Starnes
6,166,489 A 12/2000 Thompson
6,177,915 B1 1/2001 Beeteson
6,225,846 B1 5/2001 Wada
6,229,508 B1 5/2001 Kane
6,232,939 B1 5/2001 Saito
6,246,180 B1 6/2001 Nishigaki
6,252,248 B1 6/2001 Sano
6,259,424 B1 7/2001 Kurogane
6,274,887 B1 8/2001 Yamazaki
6,288,696 B1 9/2001 Holloman
6,300,928 B1 10/2001 Kim
6,303,963 B1 10/2001 Ohtani
6,306,694 B1 10/2001 Yamazaki
6,307,322 B1 10/2001 Dawson
6,316,786 B1 11/2001 Mueller
6,320,325 B1 11/2001 Cok
6,323,631 B1 11/2001 Juang
6,323,832 B1 11/2001 Nishizawa
6,345,085 B1 2/2002 Yeo
6,348,835 B1 2/2002 Sato
6,365,917 B1 4/2002 Yamazaki
6,373,453 B1 4/2002 Yudasaka
6,384,427 B1 5/2002 Yamazaki
6,392,617 B1 5/2002 Gleason
6,399,988 B1 6/2002 Yamazaki
6,414,661 B1 7/2002 Shen
6,420,758 B1 7/2002 Nakajima
6,420,834 B2 7/2002 Yamazaki
6,420,988 B1 7/2002 Azami
6,433,488 B1 8/2002 Bu
6,445,376 B2 9/2002 Parrish
6,468,638 B2 10/2002 Jacobsen
6,489,952 B1 12/2002 Tanaka
6,501,098 B2 12/2002 Yamazaki
6,501,466 B1 12/2002 Yamagashi
6,512,271 B1 1/2003 Yamazaki
6,518,594 B1 2/2003 Nakajima
6,524,895 B2 2/2003 Yamazaki
6,531,713 B1 3/2003 Yamazaki
6,559,594 B2 5/2003 Fukunaga
6,573,195 B1 6/2003 Yamazaki
6,573,584 B1 6/2003 Nagakari
6,576,926 B1 6/2003 Yamazaki
6,577,302 B2 6/2003 Hunter
6,580,408 B1 6/2003 Bae
6,580,657 B2 6/2003 Sanford
6,583,775 B1 6/2003 Sekiya
6,583,776 B2 6/2003 Yamazaki
6,587,086 B1 7/2003 Koyama
6,593,691 B2 7/2003 Nishi
6,594,606 B2 7/2003 Everitt
6,597,203 B2 7/2003 Forbes
6,611,108 B2 8/2003 Kimura
6,617,644 B1 9/2003 Yamazaki
6,618,030 B2 9/2003 Kane
6,641,933 B1 11/2003 Yamazaki
6,661,180 B2 12/2003 Koyama
6,661,397 B2 12/2003 Mikami
6,670,637 B2 12/2003 Yamazaki
6,677,713 B1 1/2004 Sung
6,680,577 B1 1/2004 Inukai
6,687,266 B1 2/2004 Ma
6,690,344 B1 2/2004 Takeuchi
6,693,388 B2 2/2004 Oomura
6,693,610 B2 2/2004 Shannon
6,697,057 B2 2/2004 Koyama
6,720,942 B2 4/2004 Lee
6,734,636 B2 5/2004 Sanford
6,738,034 B2 5/2004 Kaneko
6,738,035 B1 5/2004 Fan
6,771,028 B1 8/2004 Winters
6,777,712 B2 8/2004 Sanford
6,780,687 B2 8/2004 Nakajima
6,806,638 B2 10/2004 Lih
6,806,857 B2 10/2004 Sempel
6,809,706 B2 10/2004 Shimoda
6,859,193 B1 2/2005 Yumoto
6,861,670 B1 3/2005 Ohtani
6,873,117 B2 3/2005 Ishizuka
6,873,320 B2 3/2005 Nakamura
6,878,968 B1 4/2005 Ohnuma
6,909,114 B1 6/2005 Yamazaki
6,909,419 B2 6/2005 Zavracky
6,919,871 B2 7/2005 Kwon
6,937,215 B2 8/2005 Lo
6,940,214 B1 9/2005 Komiya
6,943,500 B2 9/2005 LeChevalier
6,954,194 B2 10/2005 Matsumoto
6,956,547 B2 10/2005 Bae
6,995,510 B2 2/2006 Murakami
6,995,519 B2 2/2006 Arnold
7,022,556 B1 4/2006 Adachi
7,023,408 B2 4/2006 Chen
7,027,015 B2 4/2006 Booth
7,034,793 B2 4/2006 Sekiya
7,088,051 B1 8/2006 Cok
7,106,285 B2 9/2006 Naugler
7,116,058 B2 10/2006 Lo
7,129,914 B2 10/2006 Knapp
7,129,917 B2 10/2006 Yamazaki
7,141,821 B1 11/2006 Yamazaki
7,161,566 B2 1/2007 Cok
7,193,589 B2 3/2007 Yoshida
7,199,516 B2 4/2007 Seo
7,220,997 B2 5/2007 Nakata
7,235,810 B1 6/2007 Yamazaki
7,245,277 B2 7/2007 Ishizuka
7,248,236 B2 7/2007 Nathan
7,264,979 B2 9/2007 Yamagata
7,274,345 B2 9/2007 Imamura
7,274,363 B2 9/2007 Ishizuka
7,279,711 B1 10/2007 Yamazaki
7,304,621 B2 12/2007 Oomori
7,310,092 B2 12/2007 Imamura
7,315,295 B2 1/2008 Kimura
7,317,429 B2 1/2008 Shirasaki
7,319,465 B2 1/2008 Mikami
7,321,348 B2 1/2008 Cok
7,339,636 B2 3/2008 Voloschenko
7,355,574 B1 4/2008 Leon
7,358,941 B2 4/2008 Ono
7,402,467 B1 7/2008 Kadono

(56) References Cited

U.S. PATENT DOCUMENTS

| | | | |
|---|---|---|---|
| 7,414,600 | B2 | 8/2008 | Nathan |
| 7,432,885 | B2 | 10/2008 | Asano |
| 7,474,285 | B2 | 1/2009 | Kimura |
| 7,485,478 | B2 | 2/2009 | Yamagata |
| 7,502,000 | B2 | 3/2009 | Yuki |
| 7,535,449 | B2 | 5/2009 | Miyazawa |
| 7,554,512 | B2 | 6/2009 | Steer |
| 7,569,849 | B2 | 8/2009 | Nathan |
| 7,619,594 | B2 | 11/2009 | Hu |
| 7,619,597 | B2 | 11/2009 | Nathan |
| 7,697,052 | B1 | 4/2010 | Yamazaki |
| 7,825,419 | B2 | 11/2010 | Yamagata |
| 7,859,492 | B2 | 12/2010 | Kohno |
| 7,868,859 | B2 | 1/2011 | Tomida |
| 7,876,294 | B2 | 1/2011 | Sasaki |
| 7,948,170 | B2 | 5/2011 | Striakhilev |
| 7,969,390 | B2 | 6/2011 | Yoshida |
| 7,995,010 | B2 | 8/2011 | Yamazaki |
| 8,044,893 | B2 | 10/2011 | Nathan |
| 8,115,707 | B2 | 2/2012 | Nathan |
| 8,378,362 | B2 | 2/2013 | Heo |
| 8,390,536 | B2 | 3/2013 | Troccoli et al. |
| 8,493,295 | B2 | 7/2013 | Yamazaki |
| 8,497,525 | B2 | 7/2013 | Yamagata |
| 9,385,169 | B2 | 7/2016 | Chaji |
| 9,606,607 | B2 | 3/2017 | Chaji |
| 9,633,597 | B2 | 4/2017 | Nathan |
| 9,685,119 | B2 | 6/2017 | Kim et al. |
| 9,721,505 | B2 | 8/2017 | Chaji et al. |
| 9,728,135 | B2 | 8/2017 | Nathan |
| 9,741,292 | B2 | 8/2017 | Nathan |
| 10,510,277 | B2 | 12/2019 | Wang |
| 10,665,157 | B2 | 5/2020 | Lin et al. |
| 2001/0002703 | A1 | 6/2001 | Koyama |
| 2001/0004190 | A1 | 6/2001 | Nishi |
| 2001/0013806 | A1 | 8/2001 | Notani |
| 2001/0015653 | A1 | 8/2001 | De Jong |
| 2001/0020926 | A1 | 9/2001 | Kujik |
| 2001/0024186 | A1 | 9/2001 | Kane |
| 2001/0026127 | A1 | 10/2001 | Yoneda |
| 2001/0026179 | A1 | 10/2001 | Saeki |
| 2001/0026257 | A1 | 10/2001 | Kimura |
| 2001/0030323 | A1 | 10/2001 | Ikeda |
| 2001/0033199 | A1 | 10/2001 | Aoki |
| 2001/0038098 | A1 | 11/2001 | Yamazaki |
| 2001/0043173 | A1 | 11/2001 | Troutman |
| 2001/0045929 | A1 | 11/2001 | Prache |
| 2001/0052606 | A1 | 12/2001 | Sempel |
| 2001/0052898 | A1 | 12/2001 | Osame |
| 2002/0000576 | A1 | 1/2002 | Inukai |
| 2002/0011796 | A1 | 1/2002 | Koyama |
| 2002/0011799 | A1 | 1/2002 | Kimura |
| 2002/0011981 | A1 | 1/2002 | Kujik |
| 2002/0015031 | A1 | 2/2002 | Fujita |
| 2002/0015032 | A1 | 2/2002 | Koyama |
| 2002/0030528 | A1 | 3/2002 | Matsumoto |
| 2002/0030647 | A1 | 3/2002 | Hack |
| 2002/0036463 | A1 | 3/2002 | Yoneda |
| 2002/0047852 | A1 | 4/2002 | Inukai |
| 2002/0048829 | A1 | 4/2002 | Yamazaki |
| 2002/0050795 | A1 | 5/2002 | Imura |
| 2002/0053401 | A1 | 5/2002 | Ishikawa |
| 2002/0070909 | A1 | 6/2002 | Asano |
| 2002/0080108 | A1 | 6/2002 | Wang |
| 2002/0084463 | A1 | 7/2002 | Sanford |
| 2002/0101172 | A1 | 8/2002 | Bu |
| 2002/0101433 | A1 | 8/2002 | McKnight |
| 2002/0113248 | A1 | 8/2002 | Yamagata |
| 2002/0122308 | A1 | 9/2002 | Ikeda |
| 2002/0130686 | A1 | 9/2002 | Forbes |
| 2002/0154084 | A1 | 10/2002 | Tanaka |
| 2002/0158823 | A1 | 10/2002 | Zavracky |
| 2002/0163314 | A1 | 11/2002 | Yamazaki |
| 2002/0167471 | A1 | 11/2002 | Everitt |
| 2002/0180369 | A1 | 12/2002 | Koyama |
| 2002/0180721 | A1 | 12/2002 | Kimura |
| 2002/0186214 | A1 | 12/2002 | Siwinski |
| 2002/0190332 | A1 | 12/2002 | Lee |
| 2002/0190924 | A1 | 12/2002 | Asano |
| 2002/0190971 | A1 | 12/2002 | Nakamura |
| 2002/0195967 | A1 | 12/2002 | Kim |
| 2002/0195968 | A1 | 12/2002 | Sanford |
| 2003/0020413 | A1 | 1/2003 | Oomura |
| 2003/0030603 | A1 | 2/2003 | Shimoda |
| 2003/0062524 | A1 | 4/2003 | Kimura |
| 2003/0063081 | A1 | 4/2003 | Kimura |
| 2003/0071804 | A1 | 4/2003 | Yamazaki |
| 2003/0071821 | A1 | 4/2003 | Sundahl |
| 2003/0076048 | A1 | 4/2003 | Rutherford |
| 2003/0090445 | A1 | 5/2003 | Chen |
| 2003/0090447 | A1 | 5/2003 | Kimura |
| 2003/0090481 | A1 | 5/2003 | Kimura |
| 2003/0095087 | A1 | 5/2003 | Libsch |
| 2003/0107560 | A1 | 6/2003 | Yumoto |
| 2003/0111966 | A1 | 6/2003 | Mikami |
| 2003/0122745 | A1 | 7/2003 | Miyazawa |
| 2003/0140958 | A1 | 7/2003 | Yang |
| 2003/0151569 | A1 | 8/2003 | Lee |
| 2003/0169219 | A1 | 9/2003 | LeChevalier |
| 2003/0174152 | A1 | 9/2003 | Noguchi |
| 2003/0178617 | A1 | 9/2003 | Appenzeller |
| 2003/0179626 | A1 | 9/2003 | Sanford |
| 2003/0197663 | A1 | 10/2003 | Lee |
| 2003/0206060 | A1 | 11/2003 | Suzuki |
| 2003/0230980 | A1 | 12/2003 | Forrest |
| 2004/0027063 | A1 | 2/2004 | Nishikawa |
| 2004/0056604 | A1 | 3/2004 | Shih |
| 2004/0066357 | A1 | 4/2004 | Kawasaki |
| 2004/0070557 | A1 | 4/2004 | Asano |
| 2004/0080262 | A1 | 4/2004 | Park |
| 2004/0080470 | A1 | 4/2004 | Yamazaki |
| 2004/0090400 | A1 | 5/2004 | Yoo |
| 2004/0108518 | A1 | 6/2004 | Jo |
| 2004/0113903 | A1 | 6/2004 | Mikami |
| 2004/0129933 | A1 | 7/2004 | Nathan |
| 2004/0130516 | A1 | 7/2004 | Nathan |
| 2004/0135749 | A1 | 7/2004 | Kondakov |
| 2004/0145547 | A1 | 7/2004 | Oh |
| 2004/0150592 | A1 | 8/2004 | Mizukoshi |
| 2004/0150594 | A1 | 8/2004 | Koyama |
| 2004/0150595 | A1 | 8/2004 | Kasai |
| 2004/0155841 | A1 | 8/2004 | Kasai |
| 2004/0174347 | A1 | 9/2004 | Sun |
| 2004/0174349 | A1 | 9/2004 | Libsch |
| 2004/0183759 | A1 | 9/2004 | Stevenson |
| 2004/0189627 | A1 | 9/2004 | Shirasaki |
| 2004/0196275 | A1 | 10/2004 | Hattori |
| 2004/0201554 | A1 | 10/2004 | Satoh |
| 2004/0207615 | A1 | 10/2004 | Yumoto |
| 2004/0233125 | A1 | 11/2004 | Tanghe |
| 2004/0239596 | A1 | 12/2004 | Ono |
| 2004/0252089 | A1 | 12/2004 | Ono |
| 2004/0257355 | A1 | 12/2004 | Naugler |
| 2004/0263437 | A1 | 12/2004 | Hattori |
| 2005/0007357 | A1 | 1/2005 | Yamashita |
| 2005/0030267 | A1 | 2/2005 | Tanghe |
| 2005/0035709 | A1 | 2/2005 | Furuie |
| 2005/0041128 | A1 | 2/2005 | Baker |
| 2005/0067970 | A1 | 3/2005 | Libsch |
| 2005/0067971 | A1 | 3/2005 | Kane |
| 2005/0068270 | A1 | 3/2005 | Awakura |
| 2005/0088085 | A1 | 4/2005 | Nishikawa |
| 2005/0088103 | A1 | 4/2005 | Kageyama |
| 2005/0110420 | A1 | 5/2005 | Arnold |
| 2005/0117096 | A1 | 6/2005 | Voloschenko |
| 2005/0140598 | A1 | 6/2005 | Kim |
| 2005/0140610 | A1 | 6/2005 | Smith |
| 2005/0145891 | A1 | 7/2005 | Abe |
| 2005/0156831 | A1 | 7/2005 | Yamazaki |
| 2005/0168416 | A1 | 8/2005 | Hashimoto |
| 2005/0206590 | A1 | 9/2005 | Sasaki |
| 2005/0225686 | A1 | 10/2005 | Brummack |
| 2005/0260777 | A1 | 11/2005 | Brabec |
| 2005/0026996 | A1 | 12/2005 | Ono |

(56) References Cited

U.S. PATENT DOCUMENTS

| | | | | |
|---|---|---|---|---|
| 2005/0269959 | A1 | 12/2005 | Uchino | |
| 2005/0285822 | A1 | 12/2005 | Reddy | |
| 2005/0285825 | A1 | 12/2005 | Eom | |
| 2006/0007072 | A1 | 1/2006 | Choi | |
| 2006/0012310 | A1 | 1/2006 | Chen | |
| 2006/0027807 | A1 | 2/2006 | Nathan | |
| 2006/0030084 | A1 | 2/2006 | Young | |
| 2006/0038758 | A1 | 2/2006 | Routley | |
| 2006/0044227 | A1 | 3/2006 | Hadcock | |
| 2006/0066527 | A1 | 3/2006 | Chou | |
| 2006/0092185 | A1 | 5/2006 | Jo | |
| 2006/0232522 | A1 | 10/2006 | Roy | |
| 2006/0261841 | A1 | 11/2006 | Fish | |
| 2006/0264143 | A1 | 11/2006 | Lee | |
| 2006/0273997 | A1 | 12/2006 | Nathan | |
| 2006/0284801 | A1 | 12/2006 | Yoon | |
| 2007/0001937 | A1 | 1/2007 | Park | |
| 2007/0001939 | A1 | 1/2007 | Hashimoto | |
| 2007/0008268 | A1 | 1/2007 | Park | |
| 2007/0008297 | A1 | 1/2007 | Bassetti | |
| 2007/0046195 | A1 | 3/2007 | Chin | |
| 2007/0069998 | A1 | 3/2007 | Naugler | |
| 2007/0080905 | A1 | 4/2007 | Takahara | |
| 2007/0080906 | A1 | 4/2007 | Tanabe | |
| 2007/0080908 | A1 | 4/2007 | Nathan | |
| 2007/0080918 | A1 | 4/2007 | Kawachi | |
| 2007/0103419 | A1 | 5/2007 | Uchino | |
| 2007/0182671 | A1 | 8/2007 | Nathan | |
| 2007/0273294 | A1 | 11/2007 | Nagayama | |
| 2007/0285359 | A1 | 12/2007 | Ono | |
| 2007/0296672 | A1 | 12/2007 | Kim | |
| 2008/0012835 | A1 | 1/2008 | Rimon | |
| 2008/0042948 | A1 | 2/2008 | Yamashita | |
| 2008/0055209 | A1 | 3/2008 | Cok | |
| 2008/0074413 | A1 | 3/2008 | Ogura | |
| 2008/0088549 | A1 | 4/2008 | Nathan | |
| 2008/0100545 | A1 | 5/2008 | Hong | |
| 2008/0111812 | A1 | 5/2008 | Shirasaki | |
| 2008/0122803 | A1 | 5/2008 | Izadi | |
| 2008/0230118 | A1 | 9/2008 | Nakatani | |
| 2009/0032807 | A1 | 2/2009 | Shinohara | |
| 2009/0051283 | A1 | 2/2009 | Cok | |
| 2009/0160743 | A1 | 6/2009 | Tomida | |
| 2009/0162961 | A1 | 6/2009 | Deane | |
| 2009/0174628 | A1 | 7/2009 | Wang | |
| 2009/0213046 | A1 | 8/2009 | Nam | |
| 2010/0052524 | A1 | 3/2010 | Kinoshita | |
| 2010/0078230 | A1 | 4/2010 | Rosenblatt | |
| 2010/0079711 | A1 | 4/2010 | Tanaka | |
| 2010/0097335 | A1 | 4/2010 | Jung | |
| 2010/0133994 | A1 | 6/2010 | Song | |
| 2010/0134456 | A1 | 6/2010 | Oyamada | |
| 2010/0140600 | A1 | 6/2010 | Clough | |
| 2010/0156279 | A1 | 6/2010 | Tamura | |
| 2010/0194956 | A1 | 8/2010 | Yuan et al. | |
| 2010/0237374 | A1 | 9/2010 | Chu | |
| 2010/0328294 | A1 | 12/2010 | Sasaki | |
| 2011/0090210 | A1 | 4/2011 | Sasaki | |
| 2011/0133636 | A1 | 6/2011 | Matsuo | |
| 2011/0148801 | A1 | 6/2011 | Bateman | |
| 2011/0180825 | A1 | 7/2011 | Lee | |
| 2012/0212468 | A1 | 8/2012 | Govil | |
| 2013/0009930 | A1 | 1/2013 | Cho | |
| 2013/0032831 | A1 | 2/2013 | Chaji | |
| 2013/0099692 | A1* | 4/2013 | Chaji | G09G 3/3233 315/224 |
| 2013/0113785 | A1 | 5/2013 | Sumi | |
| 2014/0340436 | A1* | 11/2014 | Kumeta | G09G 3/3233 345/691 |
| 2016/0125796 | A1* | 5/2016 | Ohara | G09G 3/30 345/77 |
| 2016/0203794 | A1 | 6/2016 | Lim et al. | |
| 2017/0032722 | A1* | 2/2017 | Wang | G09G 3/3266 |
| 2018/0082642 | A1* | 3/2018 | Yamanaka | G09G 3/3291 |
| 2018/0144674 | A1 | 5/2018 | Gupta et al. | |

FOREIGN PATENT DOCUMENTS

| | | | |
|---|---|---|---|
| CA | 2 249 592 | | 7/1998 |
| CA | 2 368 386 | | 9/1999 |
| CA | 2 242 720 | | 1/2000 |
| CA | 2 354 018 | | 6/2000 |
| CA | 2 436 451 | | 8/2002 |
| CA | 2 438 577 | | 8/2002 |
| CA | 2 483 645 | | 12/2003 |
| CA | 2 463 653 | | 1/2004 |
| CA | 2498136 | | 3/2004 |
| CA | 2522396 | | 11/2004 |
| CA | 2443206 | | 3/2005 |
| CA | 2472671 | | 12/2005 |
| CA | 2567076 | | 1/2006 |
| CA | 2526436 | | 2/2006 |
| CA | 2526782 | | 4/2006 |
| CN | 1381032 | | 11/2002 |
| CN | 1448908 | | 10/2003 |
| CN | 1776922 | | 5/2006 |
| CN | 101032027 | A | 9/2007 |
| CN | 101118923 | A | 2/2008 |
| CN | 101256293 | A | 9/2008 |
| CN | 101727237 | A | 6/2010 |
| CN | 102113039 | A | 6/2011 |
| CN | 102246220 | A | 11/2011 |
| CN | 102799331 | A | 11/2012 |
| CN | 102955600 | A | 3/2013 |
| CN | 105830144 | A | 8/2016 |
| DE | 20 2006 005427 | | 6/2006 |
| EP | 0 940 796 | | 9/1999 |
| EP | 1 028 471 | A | 8/2000 |
| EP | 1 103 947 | | 5/2001 |
| EP | 1 130 565 | A1 | 9/2001 |
| EP | 1 184 833 | | 3/2002 |
| EP | 1 194 013 | | 4/2002 |
| EP | 1 310 939 | | 5/2003 |
| EP | 1 335 430 | A1 | 8/2003 |
| EP | 1 372 136 | | 12/2003 |
| EP | 1 381 019 | | 1/2004 |
| EP | 1 418 566 | | 5/2004 |
| EP | 1 429 312 | A | 6/2004 |
| EP | 1 439 520 | | 7/2004 |
| EP | 1 465 143 | A | 10/2004 |
| EP | 1 467 408 | | 10/2004 |
| EP | 1 517 290 | | 3/2005 |
| EP | 1 521 203 | A2 | 4/2005 |
| EP | 2317499 | | 5/2011 |
| GB | 2 205 431 | | 12/1988 |
| JP | 09 090405 | | 4/1997 |
| JP | 10-153759 | | 6/1998 |
| JP | 10-254410 | | 9/1998 |
| JP | 11 231805 | | 8/1999 |
| JP | 11-282419 | | 10/1999 |
| JP | 2000/056847 | | 2/2000 |
| JP | 2000-077192 | | 3/2000 |
| JP | 2000-089198 | | 3/2000 |
| JP | 2000-352941 | | 12/2000 |
| JP | 2002-91376 | | 3/2002 |
| JP | 2002-268576 | | 9/2002 |
| JP | 2002-278513 | | 9/2002 |
| JP | 2002-333862 | | 11/2002 |
| JP | 2003-022035 | | 1/2003 |
| JP | 2003-076331 | | 3/2003 |
| JP | 2003-150082 | | 5/2003 |
| JP | 2003-177709 | | 6/2003 |
| JP | 2003-271095 | | 9/2003 |
| JP | 2003-308046 | | 10/2003 |
| JP | 2005-057217 | | 3/2005 |
| JP | 2006065148 | | 3/2006 |
| JP | 2009282158 | | 12/2009 |
| TW | 485337 | | 5/2002 |
| TW | 502233 | | 9/2002 |
| TW | 538650 | | 6/2003 |
| TW | 569173 | | 1/2004 |
| WO | WO 94/25954 | | 11/1994 |
| WO | WO 99/48079 | | 9/1999 |
| WO | WO 01/27910 | A1 | 4/2001 |
| WO | WO 02/067327 | A | 8/2002 |

(56) References Cited

FOREIGN PATENT DOCUMENTS

| | | |
|---|---|---|
| WO | WO 03/034389 A | 4/2003 |
| WO | WO 03/063124 | 7/2003 |
| WO | WO 03/077231 | 9/2003 |
| WO | WO 03/105117 | 12/2003 |
| WO | WO 2004/003877 | 1/2004 |
| WO | WO 2004/034364 | 4/2004 |
| WO | WO 2005/022498 | 3/2005 |
| WO | WO 2005/029455 | 3/2005 |
| WO | WO 2005/034072 | 4/2005 |
| WO | WO 2005/055185 | 6/2005 |
| WO | WO 2006/053424 | 5/2006 |
| WO | WO 2006/063448 A | 6/2006 |
| WO | WO 2006/137337 | 12/2006 |
| WO | WO 2007/003877 A | 1/2007 |
| WO | WO 2007/079572 | 7/2007 |
| WO | WO 2010/023270 | 3/2010 |

OTHER PUBLICATIONS

Alexander et al.: "Pixel ciIcuits and drive schemes for glass and elastic AMOLED displays"; dated Jul. 2005 (9 pages).
Alexander et al.: "Unique Electrical Measurement Technology for Compensation, Inspection, and Process Diagnostics of AMOLED HDTV"; dated May 2010 (4 pages).
Ashtiani et al.: "AMOLED Pixel Circuit With Electronic Compensation of Luminance Degradation"; dated Mar. 2007 (4 pages).
Chaji et al.: "A Current-Mode Comparator for Digital Calibration of Amorphous Silicon AMOLED Displays"; dated Jul. 2008 (5 pages).
Chaji et al.: "A fast settling current driver based on the CCII for AMOLED displays"; dated Dec. 2009 (6 pages).
Chaji et al.: "A Low-Cost Stable Amorphous Silicon AMOLED Display with Full V~T- and V~O~L~E~D Shift Compensation"; dated May 2007 (4 pages).
Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H Amoled pixel circuit based on short-term stress stability of a-Si:H TFTs"; dated Oct. 2005 (3 pages).
Chaji et al.: "A Novel Driving Scheme and Pixel Circuit for AMOLED Displays"; dated Jun. 2006 (4 pages).
Chaji et al.: "A novel driving scheme for high-resolution large-area a-Si:H AMOLED displays"; dated Aug. 2005 (4 pages).
Chaji et al.: "A Stable Voltage-Programmed Pixel Circuit for a-Si:H Amoled Displays"; dated Dec. 2006 (12 pages).
Chaji et al.: "A Sub-μA fast-settling current-programmed pixel circuit for AMOLED displays"; dated Sep. 2017.
Chaji et al.: "An Enhanced and Simplified Optical Feedback Pixel Circuit for AMOLED Displays"; dated Oct. 2006.
Chaji et al.: "Compensation technique for DC and transient instability of thin film transistor circuits for large-area devices"; dated Aug. 2008.
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "Electrical Compensation of OLED Luminance Degradation"; dated Dec. 2007 (3 pages).
Chaji et al.: "eUTDSP: a design study of a new VLIW-based DSP architecture"; dated May 2003 (4 pages).
Chaji et al.: "Fast and Offset-Leakage Insensitive Current-Mode Line Driver for Active Matrix Displays and Sensors"; dated Feb. 2009 (8 pages).
Chaji et al.: "High Speed Low Power Adder Design With a New Logic Style: Pseudo Dynamic Logic (SDL)"; dated Oct. 2001 (4 pages).
Chaji et al.: "High-precision, fast current source for large-area current-programmed a-Si flat panels"; dated Sep. 2006 (4 pages).
Chaji et al.: "Low-Cost AMOLED Television with IGNIS Compensating Technology"; dated May 2008 (4 pages).
Chaji et al.: "Low-Cost Stable a-Si:H AMOLED Display for Portable Applications"; dated Jun. 2006 (4 pages).
Chaji et al.: "Low-Power Low-Cost Voltage-Programmed a-Si:H AMOLED Display"; dated Jun. 2998 (5 pages).
Chaji et al.: "Merged phototransistor pixel with enhanced near infrared response and flicker noise reduction for biomolecular imaging"; dated Nov. 2008 (3 pages).
Chaji et al.: "Parallel Addressing Scheme for Voltage-Programmed Active-Matrix OLED Displays"; dated May 2007 (6 pages).
Chaji et al.: "Pseudo dynamic logic (SDL): a high-speed and low-power dynamic logic family"; dated 2002 (4 pages).
Chaji et al.: "Stable a-Si:H circuits based on short-term stress stability of amorphous silicon thin film transistors"; dated May 2006 (4 pages).
Chaji et al.: "Stable Pixel Circuit for Small-Area High-Resolution a-Si:H AMOLED Displays"; dated Oct. 2008 (6 pages).
Chaji et al.: "Stable RGBW AMOLED display with OLED degradation compensation using electrical feedback"; dated Feb. 2010 (2 pages).
Chaji et al.: "Thin-Film Transistor Integration for Biomedical Imaging and AMOLED Displays"; dated 2008 (177 pages).
European Search Report and Written Opinion for Application No. 08 86 5338 dated Nov. 2, 2011 (7 pages).
European Search Report for European Application No. EP 04 78 6661 dated Mar. 9, 2009.
European Search Report for European Application No. EP 05 75 9141 dated Oct. 30, 2009.
European Search Report for European Application No. EP 05 82 1114 dated Mar. 27, 2009 (2 pages).
European Search Report for European Application No. EP 07 71 9579 dated May 20, 2009.
European Search Report dated Mar. 26, 2012 in corresponding European Patent Application No. 10000421.7 (6 pages).
Extended European Search Report dated Apr. 27, 2011 issued during prosecution of European patent application No. 09733076.5 (13 pages).
Goh et al., "A New a-Si:H Thin Film Transistor Pixel Circul for Active-Matrix Organic Light-Emitting Diodes", IEEE Electron Device Letters, vol. 24, No. 9, Sep. 2003, 4 pages.
International Search Report for International Application No. PCT/CA02/00180 dated Jul. 31, 2002 (3 pages).
International Search Report for International Application No. PCT/CA2004/001741 dated Feb. 21, 2005.
International Search Report for International Application No. PCT/CA2005/001844 dated Mar. 28, 2006 (2 pages).
International Search Report for International Application No. PCT/CA2005/001007 dated Oct. 18, 2005.
International Search Report for International Application No. PCT/CA2007/000652 dated Jul. 25, 2007.
International Search Report for International Application No. PCT/CA2008/002307, dated Apr. 28, 2009 (3 pages).
International Search Report for International Application No. PCT/IB2011/055135, Canadian Patent Office, dated Apr. 16, 2012 (5 pages).
International Search Report dated Jul. 30, 2009 for International Application No. PCT/CA2009/000501 (4 pages).
Jafarabadiashtiani et al.: "A New Driving Method for a-Si AMOLED Displays Based on Voltage Feedback"; dated 2005 (4 pages).
Lee et al.: "Ambipolar Thin-Film Transistors Fabricated by PECVD Nanocrystalline Silicon"; dated 2006 (6 pages).
Ma e y et al: "Organic Light-Emitting Diode/Thin Film Transistor Integration for foldable Displays" Conference record of the 1997 International display research conference and international workshops on LCD technology and emissive technology. Toronto, Sep. 15-19, 1997 (6 pages).
Matsueda y et al.: "35.1: 2.5-in. AMOLED with Integrated 6-bit Gamma Compensated Digital Data Driver"; dated May 2004.
Nathan et al.: "Backplane Requirements for Active Matrix Organic Light Emitting Diode Displays"; dated 2006 (16 pages).

(56) References Cited

OTHER PUBLICATIONS

Nathan et al.: "Call for papers second international workshop on compact thin-film transistor (TFT) modeling for circuit simulation"; dated Sep. 2009 (1 page).
Nathan et al.: "Driving schemes for a-Si and LTPS AMOLED displays"; dated Dec. 2005 (11 pages).
Nathan et al.: "Invited Paper: a-Si for AMOLED—Meeting the Performance and Cost Demands of Display Applications (Cell Phone to HDTV)"; dated 2006 (4 pages).
Nathan et al.: "Thin film imaging technology on glass and plastic" ICM 2000, Proceedings of the 12th International Conference on Microelectronics, (IEEE Cat. No. 00EX453), Tehran Iran; dated Oct. 31-Nov. 2, 2000, pp. 11-14, ISBN: 964-360-057-2, p. 13, col. 1, line 11-48; (4 pages).
Nathan et al., "Amorphous Silicon Thin Film Transistor Circuit Integration for Organic LED Displays on Glass and Plastic", IEEE Journal of Solid-State Circuits, vol. 39, No. 9, Sep. 2004, pp. 1477-1486.
Office Action issued in Chinese Patent Application 200910246264.4 dated Jul. 5, 2013; 8 pages.
Patent Abstracts of Japan, vol. 2000, No. 09, Oct. 13, 2000—JP 2000 172199 A, Jun. 3, 2000, abstract.
Patent Abstracts of Japan, vol. 2002, No. 03, Apr. 3, 2002 (Apr. 4, 2004 & JP 2001 318627 A (Semiconductor EnergyLab DO LTD), Nov. 16, 2001, abstract, paragraphs '01331-01801, paragraph '01691, paragraph '01701, paragraph '01721 and figure 10.
Philipp: "Charge transfer sensing" Sensor Review, vol. 19, No. 2, Dec. 31, 1999 (Dec. 31, 1999), 10 pages.
Rafati et al.: "Comparison of a 17 b multiplier in Dual-rail domino and in Dual-rail D L (D L) logic styles"; dated 2002 (4 pages).
Safavaian et al.: "Three-TFT image sensor for real-time digital X-ray imaging"; dated Feb. 2, 2006 (2 pages).
Safavian et al.: "3-TFT active pixel sensor with correlated double sampling readout circuit for real-time medical x-ray imaging"; dated Jun. 2006 (4 pages).
Safavian et al.: "A novel current scaling active pixel sensor with correlated double sampling readout circuit for real time medical x-ray imaging"; dated May 2007 (7 pages).
Safavian et al.: "A novel hybrid active-passive pixel with correlated double sampling CMOS readout circuit for medical x-ray imaging"; dated May 2008 (4 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy [5969D-82]"; dated Sep. 2005 (9 pages).
Sanford, James L., et al., "4.2 TFT AMOLED Pixel Circuits and Driving Methods", SID 03 Digest, ISSN/0003, 2003, pp. 10-13.
Stewart M. et al., "Polysilicon TFT technology for active matrix OLED displays" IEEE transactions on electron devices, vol. 48, No. 5; Dated May 2001 (7 pages).
Tatsuya Sasaoka et al., 24.4L; Late-News Paper: a 13.9-inch AM-OLED Display with Top Emitting Structure and Adaptive Current Mode Programmed Pixel Circuit (TAC), SID 01 Digest, (2001), pp. 384-387.
Vygranenko et al.: "Stability of indium-oxide thin-film transistors by reactive ion beam assisted deposition"; dated 2009.
Wang et al.: "Indium oxides by reactive ion beam assisted evaporation: From material study to device application"; dated Mar. 2009 (6 pages).
Written Opinion dated Jul. 30, 2009 for International Application No. PCT/CA2009/000501 (6 pages).
Yi He et al., "Current-Source a-Si:H Thin Film Transistor Circuit for Active-Matrix Organic Light-Emitting Displays", IEEE Electron Device Letters, vol. 21, No. 12, Dec. 2000, pp. 590-592.
Zhiguo Meng et al; "24.3: Active-Matrix Organic Light-Emitting Diode Display implemented Using Metal-Induced Unilaterally Crystallized Polycrystalline Silicon Thin-Film Transistors", SID 01Digest, (2001), pp. 380-383.
International Search Report for Application No. PCT/IB2014/059409, Canadian Intellectual Property Office, dated Jun. 12, 2014 (4 pages).
Written Opinion for Application No. PCT/IB2014/059409, Canadian Intellectual Property Office, dated Jun. 12, 2014 (5 pages).
Extended European Search Report for Application No. EP 14181848.4, dated Mar. 5, 2015, (9 pages).
Extended European Search Report for Application No. EP 16192749.6, dated Dec. 15, 2016 (16 pages).

* cited by examiner

PIXEL MEASUREMENT THROUGH DATA LINE

CROSS REFERENCE TO RELATED APPLICATIONS

This application is a continuation of U.S. patent application Ser. No. 17/205,639, filed Mar. 18, 2021, now allowed, which is a continuation of U.S. patent application Ser. No. 16/028,073, filed Jul. 5, 2018, now U.S. Pat. No. 10,971,078, which is a continuation-in-part of U.S. patent application Ser. No. 15/968,134, filed May 1, 2018, which claims the benefit of U.S. Provisional Application No. 62/629,450, each of which is hereby incorporated by reference herein in their entireties.

BACKGROUND

Organic light emitting diode (OLED) displays have gained significant interest recently in display applications in view of their faster response times, larger viewing angles, higher contrast, lighter weight, lower power, amenability to flexible substrates, as compared to liquid crystal displays (LCDs).

OLED displays can be created from an array of light emitting devices each controlled by individual circuits (i.e., pixel circuits) having transistors for selectively controlling the circuits to be programmed with display information and to emit light according to the display information. Thin film transistors ("TFTs") fabricated on a substrate can be incorporated into such displays. TFTs tend to demonstrate non-uniform behavior across display panels and over time as the displays age. Compensation techniques can be applied to such displays to achieve image uniformity across the displays and to account for degradation in the displays as the displays age. Some schemes for providing compensation to displays to account for variations across the display panel and over time utilize monitoring systems to measure time dependent parameters associated with the aging (i.e., degradation) of the pixel circuits. The measured information can then be used to inform subsequent programming of the pixel circuits so as to ensure that any measured degradation is accounted for by adjustments made to the programming. The prior art monitored pixel circuits, however, require the use of additional feedback lines and transistors to selectively couple the pixel circuits to the monitoring systems and provide for reading out information. The incorporation of additional feedback lines and transistors may undesirably add significantly to the cost yield and reduces the allowable pixel density on the panel.

SUMMARY OF THE INVENTION

Aspects of the present disclosure include a method of determining the current of a pixel circuit connected to a source driver by a data line. The method includes supplying voltage (or current) to the pixel circuit from the source via the data line, measuring the current and extracting the value of the voltage from the current measurement. The pixel circuit may include a light-emitting device, such as an organic light emitting diode (OLED), and may also include a thin field transistor (TFT).

In this aspect of the present disclosure further includes the source driver having a readout circuit that is utilized for measuring the current provided by the source driver to the pixel circuit. The current is converted into a digital code, i.e.

a 10 to 16 bit digital code. The digital code is provided to a digital processor for further processing.

The foregoing and additional aspects and embodiments of the present invention will be apparent to those of ordinary skill in the art in view of the detailed description of various embodiments and/or aspects, which is made with reference to the drawings, a brief description of which is provided next.

DETAILED DESCRIPTION

Figure 1:
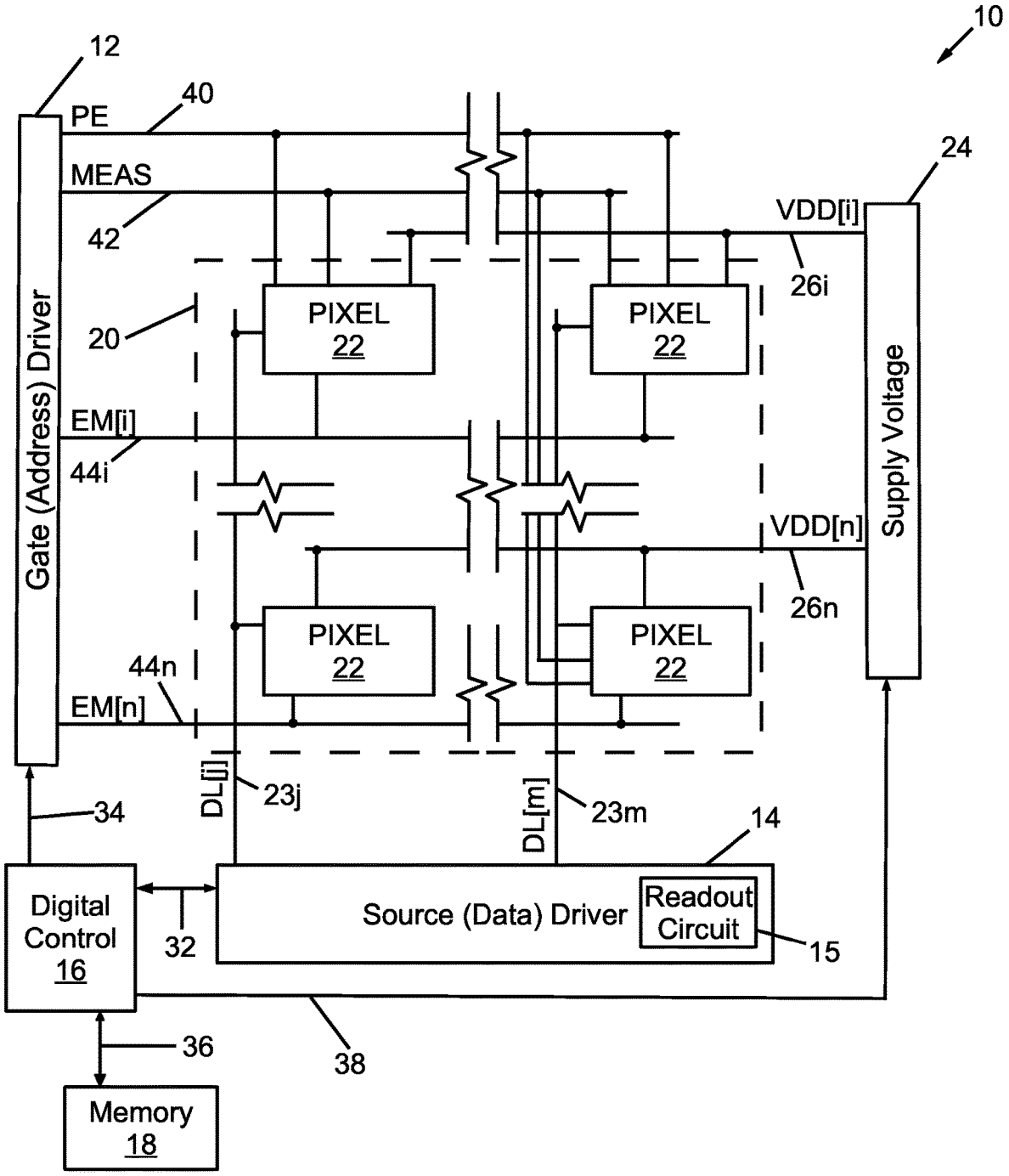
FIG. 1 is a block diagram of an OLED display in accordance with embodiments of the present invention.

FIG. 1 is a diagram of an exemplary display system 10. The display system 10 includes a gate driver 12, a source driver 14, a digital controller 16, a memory storage 18, and display panel 20. The display panel 20 includes an array of pixels 22 arranged in rows and columns. Each of the pixels 22 is individually programmable to emit light with individually programmable luminance values. The controller 16 receives digital data indicative of information to be displayed on the display panel 20. The controller 16 sends signals 32 to the source driver 14 and scheduling signals 34 to the gate driver 12 to drive the pixels 22 in the display panel 20 to display the information indicated. The plurality of pixels 22 associated with the display panel 20 thus comprise a display array ("display screen") adapted to dynamically display information according to the input digital data received by the controller 16. The display screen can display, for example, video information from a stream of video data received by the controller 16. The supply voltage 24 can provide a constant power voltage or can be an adjustable voltage supply that is controlled by signals from the controller 116. The display system 10 can also incorporate features from a current source or sink (not shown) to provide biasing currents to the pixels 22 in the display panel 20 to thereby decrease programming time for the pixels 22.

For illustrative purposes, the display system 10 in FIG. 1 is illustrated with only four pixels 22 in the display panel 20. It is understood that the display system 10 can be implemented with a display screen that includes an array of similar pixels, such as the pixels 22, and that the display screen is not limited to a particular number of rows and columns of pixels. For example, the display system 10 can be implemented with a display screen with a number of rows and columns of pixels commonly available in displays for mobile devices, monitor-based devices, and/or projection-devices.

The pixel 22 is operated by a driving circuit ("pixel circuit") that generally includes a driving transistor and a light emitting device. Hereinafter the pixel 22 may refer to the pixel circuit. The light emitting device can optionally be an organic light emitting diode, but implementations of the present disclosure apply to pixel circuits having other electroluminescence devices, including current-driven light emitting devices. The driving transistor in the pixel 22 can optionally be an n-type or p-type amorphous silicon thin-film transistor, but implementations of the present disclosure are not limited to pixel circuits having a particular polarity of transistor or only to pixel circuits having thin-film transistors. The pixel circuit 22 can also include a storage capacitor for storing programming information and allowing the pixel circuit 22 to drive the light emitting device after being addressed. Thus, the display panel 20 can be an active matrix display array.

As illustrated in FIG. 1, the pixel 22 illustrated as the top-left pixel in the display panel 20 is coupled to a power enable (PE) signal line 40, measurement (MEAS) signal line 42, a supply line 26*i*, a data line 23*j*, and an enable measurement (EM) signal line 44*i*. The supply line 26*i* may be charged with VDD.

The top-left pixel 22 in the display panel 20 can correspond a pixel in the display panel in a "ith" row and "jth" column of the display panel 20. Similarly, the top-right pixel 22 in the display panel 20 represents a "jth" row and "mth" column; the bottom-left pixel 22 represents an "nth" row and "jth" column; and the bottom-right pixel 22 represents an "nth" row and "mth" column. Each of the pixels 22 is coupled to the PE signal line 40, MEAS signal line 42; along with the appropriate supply lines (e.g., the supply lines 26*i* and 26*n*), data lines (e.g., the data lines 23*j* and 23*m*), and EM signal lines (e.g., the EM signal lines 44*i* and 44*n*). It is noted that aspects of the present disclosure apply to pixels having additional connections, such as connections to a select line.

With reference to the top-left pixel 22 shown in the display panel 20, PE signal line 40 and MEAS signal line 42 are provided by the gate driver 12, and can be utilized to enable, for example, a programming operation of the pixel 22 by activating a switch or transistor to allow the data line 23*j* to program the pixel 22. The data line 23*j* conveys programming information from the source driver 14 to the pixel 22. For example, the data line 23*j* can be utilized to apply a programming voltage or a programming current to the pixel 22 in order to program the pixel 22 to emit a desired amount of luminance. The programming voltage (or programming current) supplied by the source driver 14 via the data line 23*j* is a voltage (or current) appropriate to cause the pixel 22 to emit light with a desired amount of luminance according to the digital data received by the controller 16. The programming voltage (or programming current) can be applied to the pixel 22 during a programming operation of the pixel 22 so as to charge a storage device within the pixel 22, such as a storage capacitor, thereby enabling the pixel 22 to emit light with the desired amount of luminance during an emission operation following the programming operation. For example, the storage device in the pixel 22 can be charged during a programming operation to apply a voltage to one or more of a gate or a source terminal of the driving transistor during the emission operation, thereby causing the driving transistor to convey the driving current through the light emitting device according to the voltage stored on the storage device.

Generally, in the pixel 22, the driving current that is conveyed through the light emitting device by the driving transistor during the emission operation of the pixel 22 is a current that is supplied by the supply line 26*i*. The supply line 26*i* can provide a positive supply voltage (e.g., the voltage commonly referred to in circuit design as "VDD").

The display system 10 also includes a readout circuit 15 which is integrated with the source driver 14. With reference again to the top left pixel 22 in the display panel 20, the data line 23*j* connects the pixel 22 to the readout circuit 15. The data line 23*j* allows the readout circuit 15 to measure a current associated with the pixel 22 and hereby extract information indicative of a degradation of the pixel 22. Readout circuit 15 converts the associated current to a corresponding voltage. This voltage is converted into a 10 to 16 bit digital code and is sent to the digital control 16 for further processing or compensation.

Figure 2:
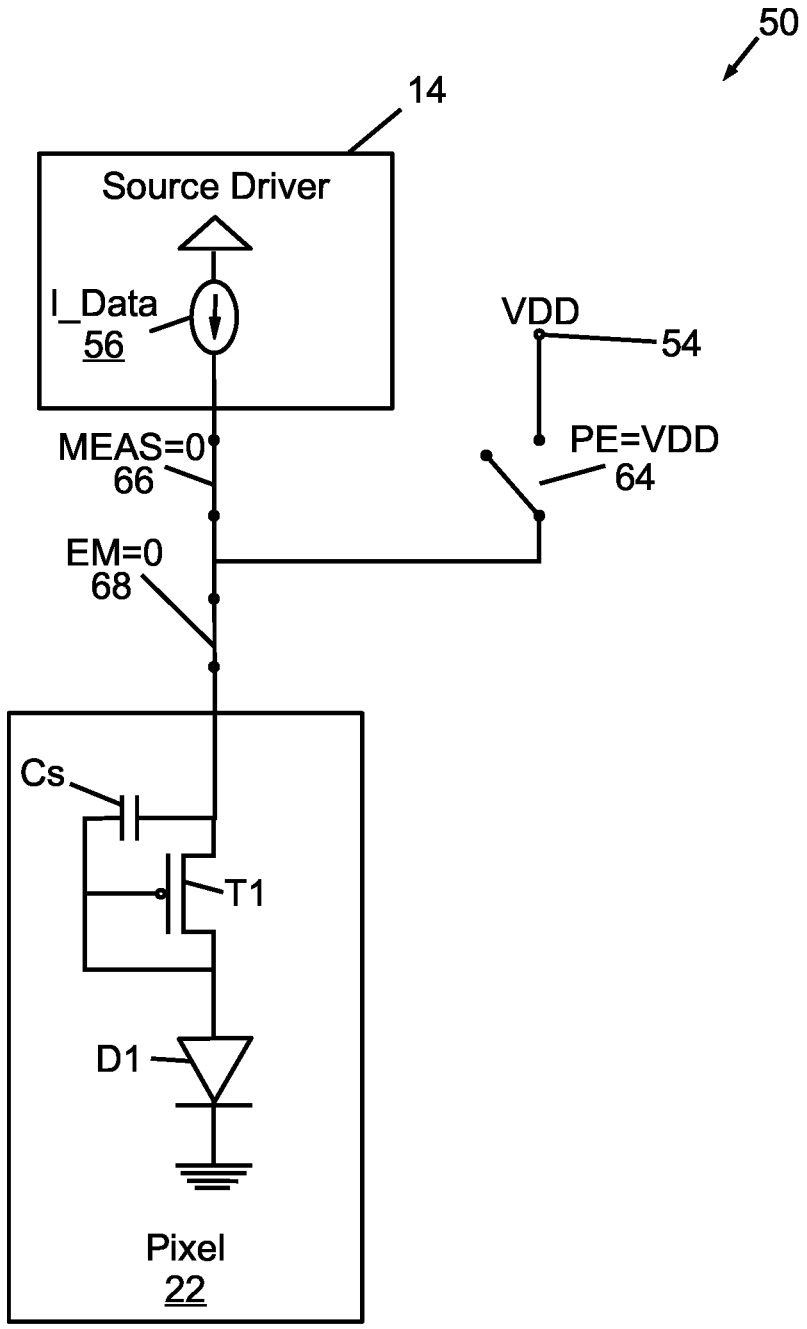
FIG. 2 is a block diagram of an embodiment of a pixel driver circuit in programming mode for the OLED display in FIG. 1.

FIG. 2 is a circuit diagram of a simple individual driver circuit 50 which contains a pixel 22, a source driver 14 and three switches controlling by MEAS 66, EM 68 and PE 64 signal. The pixel 22 in FIG. 2 include a drive transistor T1 coupled to an organic light emitting device D1 and a storage capacitor $C_s$ for storing programming information and allowing the pixel circuit 22 to drive the light emitting device after being addressed. In FIG. 2, circuit 50 is in programming mode.

As explained above, each pixel 22 in the display panel 20 in FIG. 1 is driven by the method shown in the driver circuit 50 in FIG. 2. The driver circuit 50 includes a drive transistor T1 coupled to an organic light emitting device D1, a storage capacitor $C_s$ for storing programming information and a source driver 14 and three switches controlling by MEAS 66, EM 68 and PE 64 signal. In this example, the organic light emitting device D1 is a luminous organic material which is activated by current flow and whose brightness is a function of the magnitude of the current. A supply voltage input 54 is coupled to the drain of the drive transistor T1. The supply voltage input 54 in conjunction with the drive transistor T1 supplies current to the light emitting device D1. The current level may be controlled via the source driver 14 in FIG. 1. In one example, the drive transistor T1 is a thin film transistor fabricated from hydrogenated amorphous silicon. In another example, low-temperature polycrystalline-silicon thin-film transistor ("LTPS-TFT") technology can also be used. Other circuit components such as capacitors and transistors (not shown) may be added to the simple driver circuit 50 to allow the pixel to operate with various enable, select and control signals such as those input by the gate driver 12 in FIG. 1. Such components are used for faster programming of the pixels, holding the programming of the pixel during different frames and other functions.

When the pixel 22 is required to have a defined brightness in applications, the gate of the drive transistor T1 is charged to a voltage where the transistor T1 generates a corresponding current to flow through the organic light emitting device (OLED) D1, creating the required brightness. The voltage at the gate of the transistor T1 can be either created by direct charging of the node with a voltage or self-adjusted with an external current.

During the programming mode, rows of pixels 22 are selected on a row by row basis. For example, the "ith" row of pixels 22 are selected and enabled by the gate driver 12, in which the EM signal line 44*i* is set to zero, i.e. EM=0. All pixels 22 in the "ith" row are connected to the source driver 14, such that the MEAS signal line 42 is set to zero, i.e. MEAS=0, and the PE signal line 40 is set to equal VDD, i.e. PE=VDD, for the "ith" row. The data is converted to data current, referred to as I_DATA 56 and flows into pixel. This data current 56 generates a Vgs voltage in T1 transistor which is stored in $C_s$ capacitor. When the pixel is in operational mode and is connected VDD, the voltage stored in $C_s$ capacitor generated a current in T1 transistor which is equal to I_DATA 56.

Figure 3:
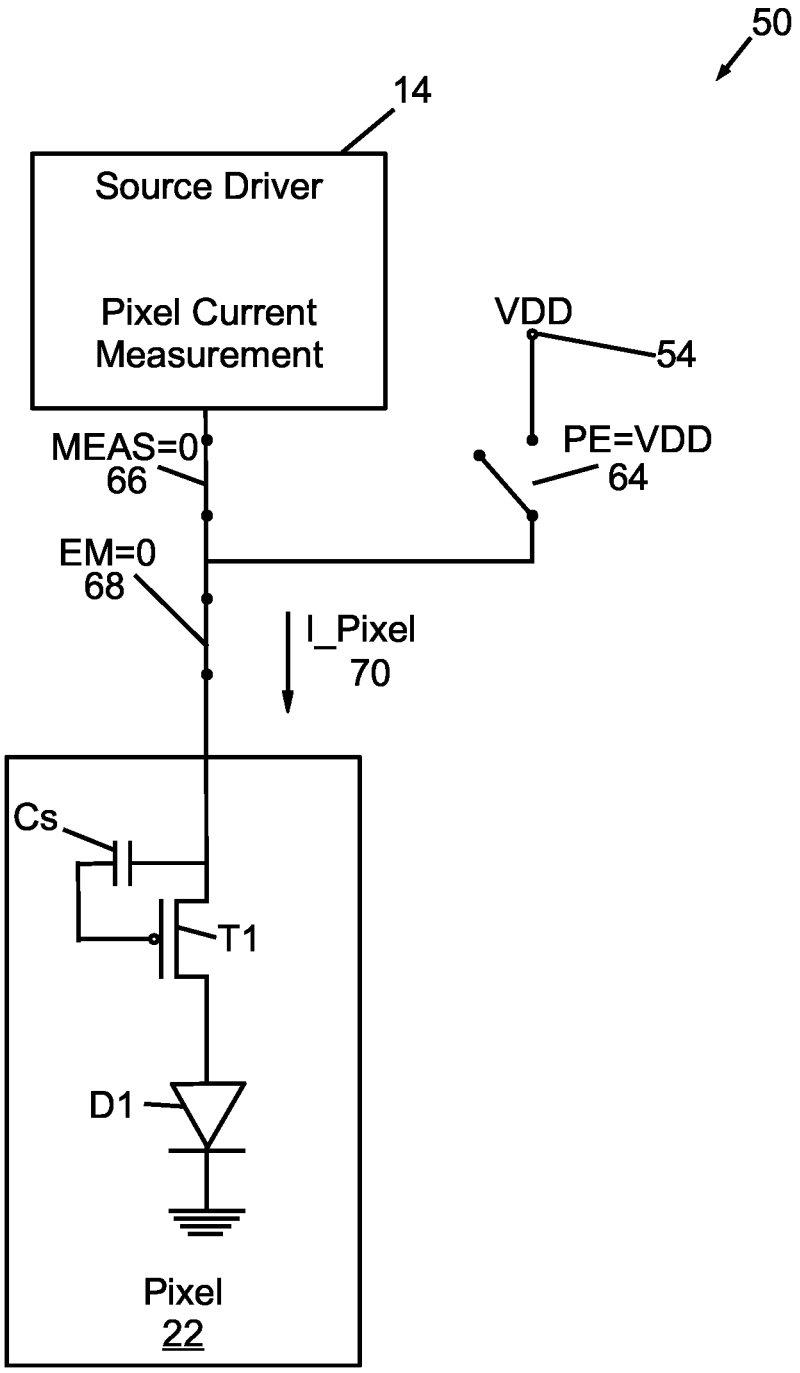
FIG. 3 is a block diagram of an embodiment of a pixel driver circuit in measurement mode for the OLED display in FIG. 1.

FIG. 3 is the circuit diagram of the simple individual driver circuit 50 as illustrated in FIG. 2 when in measurement mode. During the measurement mode, each row of pixels 22 are selected on a row by row basis, and enabled by the gate driver 11, i.e. EM=0, and all pixels 22 are connected to the source driver 14, i.e. MEAS=0 and PE=VDD, as described in FIG. 2. The pixel current, I_Pixel, 70 flows into source driver 14 and is measured by a Readout Circuit (ROC) 15. The ROC 15 measures the pixel current 70 and converts it to a correspondence voltage. This voltage is converted to 10 to 16 bit digital code and is sent to digital processor to be used for further processing or compensation.

Figure 4:
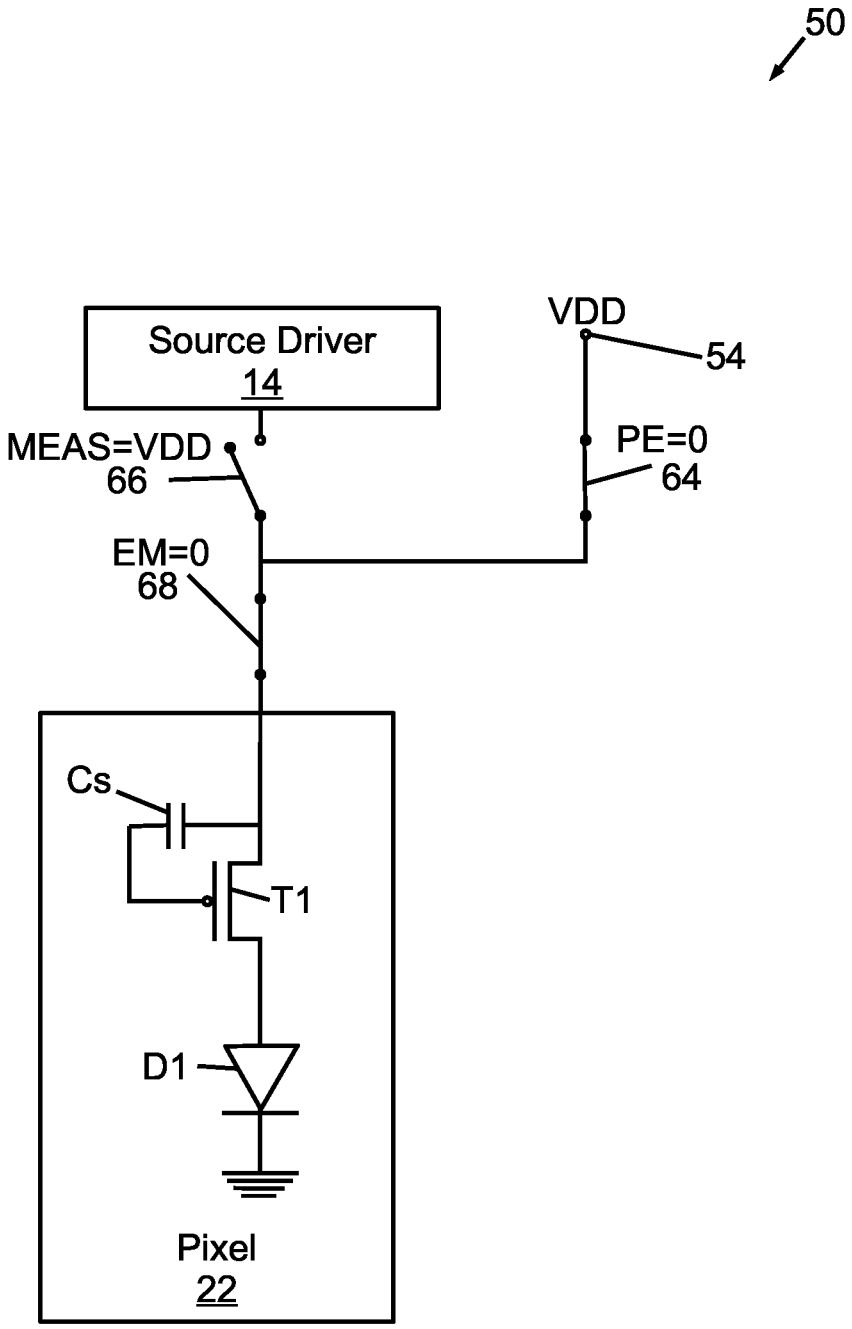
FIG. 4 is a block diagram of an embodiment of a pixel driver circuit in normal operation mode for the OLED display in FIG. 1.

FIG. 4 is the circuit diagram of the simple individual driver circuit 50 as illustrated in FIG. 2 when in normal operation mode. Normal operation mode may occur after the programming of all the rows. During normal operation mode, all pixels 22 are connected to their specific supply line, e.g. the "ith" row is connected to supply line 26*i*, while all pixels are disconnected from source driver 14, such that the MEAS signal line 42 is set to VDD, i.e. MEAS=VDD, and the PE signal line 40 is set to equal zero, i.e. PE=0, for the "ith" row. Pixel current, I_Pixel, 70 which is equal to the data current, I_Data, 56 flows into pixel 22 and OLED D1 has a luminance correspondence to the Pixel current 70.

Figure 5:
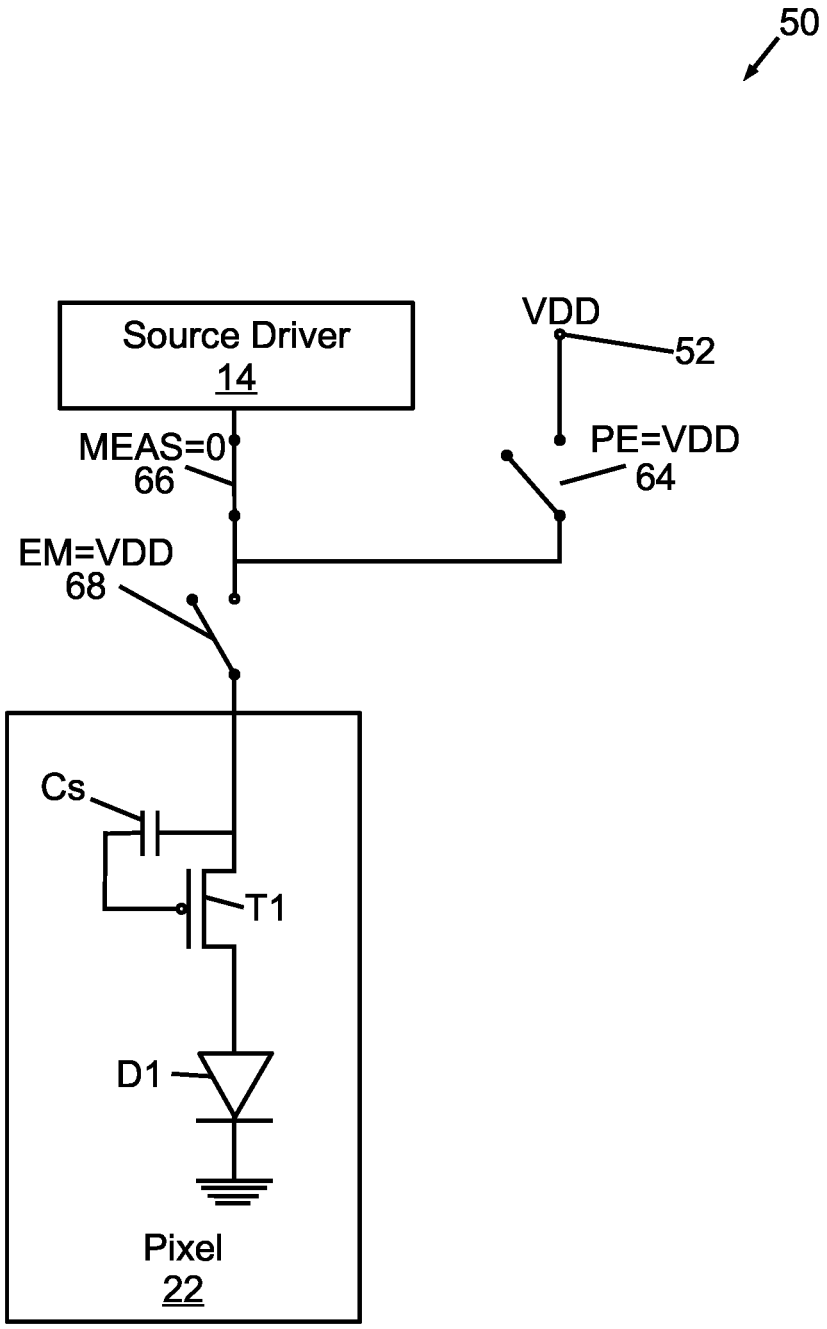
FIG. 5 is a block diagram of an embodiment of a pixel driver circuit in programming mode which is not selected by the Enable Management signal for the OLED display in FIG. 1.

FIG. 5 is the circuit diagram of the simple individual driver circuit 50 as illustrated in FIG. 2 when in programming mode but when the programming is directed toward another row. During the programming mode, the programming is performed on a row by row basis. The results in only one row of pixels 22, i.e. the "ith" row, being connected to source driver 14 while the remaining rows of pixels 22, i.e. the "jth" row, are off with no pixel current 70. During this time, the EM signal line 44*j* is set to VDD, i.e. EM=VDD, while the MEAS signal line 42 is set to zero, i.e. MEAS=0, and the PE signal line 40 is set to equal VDD, i.e. PE=VDD, for the "ith" row. During this time, there will be only a leakage current flowing into the OLED D1 and pixel 22 as shown in FIG. 5.

Figure 6:
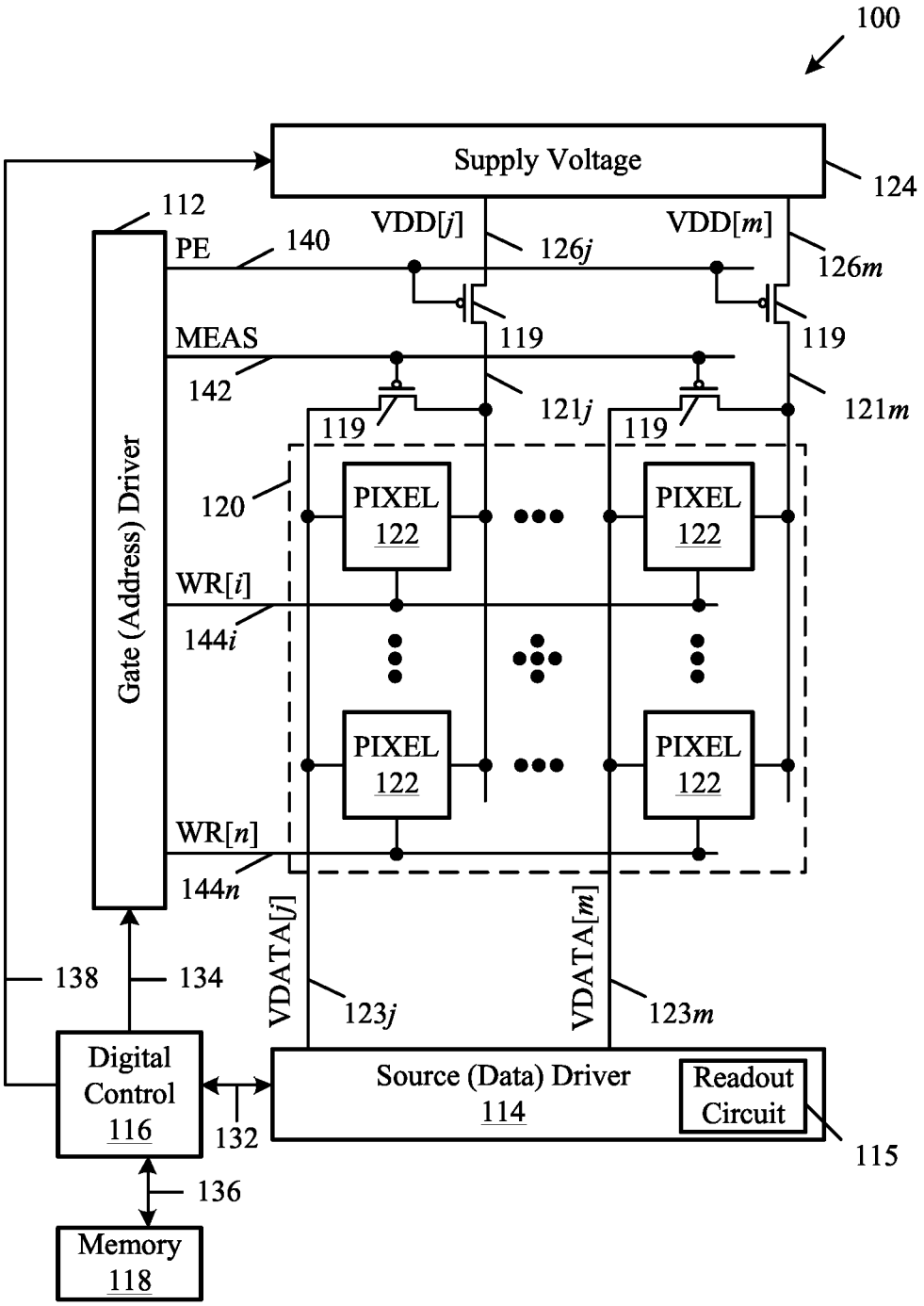
FIG. 6 is a block diagram of an OLED display in accordance with embodiments of the present invention.

FIG. 6 is a diagram of an exemplary display system 100. The display system 100 includes a gate driver 112, a source driver 114, a digital controller 116, a memory storage 118, and display panel 120 and two TFT transistors 119 working as switches for each column. The display panel 120 includes an array of pixels 122 arranged in rows and columns. Each of the pixels 122 is individually programmable to emit light with individually programmable luminance values. The controller 116 receives digital data indicative of information to be displayed on the display panel 120. The controller 116 sends signals 132 to the source driver 114 and scheduling signals 134 to the gate driver 112 to drive the pixels 122 in the display panel 120 to display the information indicated. The plurality of pixels 122 associated with the display panel 120 thus comprise a display array ("display screen") adapted to dynamically display information according to the input digital data received by the controller 116. The display screen can display, for example, video information from a stream of video data received by the controller 116. The supply voltage 124 can provide a constant power voltage or can be an adjustable voltage supply that is controlled by signals from the controller 116.

For illustrative purposes, the display system 100 in FIG. 6 is illustrated with only four pixels 122 in the display panel 120. It is understood that the display system 100 can be implemented with a display screen that includes an array of similar pixels, such as the pixels 122, and that the display screen is not limited to a particular number of rows and columns of pixels. For example, the display system 100 can be implemented with a display screen with a number of rows and columns of pixels commonly available in displays for mobile devices, monitor-based devices, and/or projection-devices.

The pixel 122 is operated by a driving circuit ("pixel circuit") that generally includes a driving transistor and a light emitting device. Hereinafter the pixel 122 may refer to the pixel circuit. The light emitting device can optionally be an organic light emitting diode (OLED), but implementations of the present disclosure apply to pixel circuits having other electroluminescence devices, including current-driven light emitting devices. The driving transistor in the pixel 122 can optionally be an n-type or p-type amorphous silicon thin-film transistor, but implementations of the present disclosure are not limited to pixel circuits having a particular polarity of transistor or only to pixel circuits having thin-film transistors. The pixel circuit 122 can also include a storage capacitor for storing programming information and allowing the pixel circuit 122 to drive the light emitting device after being addressed. Thus, the display panel 120 can be an active matrix display array.

As illustrated in FIG. 6, the pixel 122 illustrated as the top-left pixel in the display panel 120 is coupled to a power enable (PE) signal line 140, measurement (MEAS) signal line 142, a supply line 126*j*, a data line 123*j*, and a write (WR) signal line 144*i*. The supply line 126*j* may be charged with VDD.

The top-left pixel 122 in the display panel 120 can correspond a pixel in the display panel in an "ith" row and "jth" column of the display panel 120. Similarly, the top-right pixel 122 in the display panel 120 represents an "ith" row and "mth" column; the bottom-left pixel 122 represents an "nth" row and "jth" column; and the bottom-right pixel 122 represents an "nth" row and "mth" column. Each of the pixels columns is connected to two TFTs 119. One TFT 119 is coupled between the data line (123*j* and 123*m*) and pixel supply voltage line (121*j* and 121*m*) and is controlled by the PE signal line 140. The second TFT is coupled between pixel supply voltage line (121*j* and 121*m*) and supply voltage line (126*j* and 126*m*) and is controlled by the MEAS signal line 142; The display panel 120 is also coupled with the appropriate supply lines (e.g., the supply lines 126*j* and 126*m*), data lines (e.g., the data lines 123*j* and 123*m*), and write WR signal lines (e.g., the WR signal lines 144*i* and 144*n*). It is noted that aspects of the present disclosure apply to pixels having additional connections, such as connections to a select line or monitor line.

With reference to the top-left pixel 122 shown in the display panel 120, PE signal line 140, MEAS signal line 42 and W1R (144*i* and 144*n*) write signal are provided by the gate driver 112 land can be utilized to enable, for example, a programming operation of the pixel 122 by activating TFT transistors 119 and other switches or transistors in pixel 122 to allow the data line 123*j* to program the pixel 122. The data line 123*j* conveys programming information from the source driver 114 to the pixel 122. For example, the data line 123*j* can be utilized to apply a programming voltage or a programming current to the pixel 122 in order to program the pixel 122 to emit a desired amount of luminance. The programming voltage (or programming current) supplied by the source driver 114 via the data line 123*j* is a voltage (or current) appropriate to cause the pixel 122 to emit light with a desired amount of luminance according to the digital data received by the controller 116. The programming voltage (or programming current) can be applied to the pixel 122 during a programming operation of the pixel 122 so as to charge a storage device within the pixel 122, such as a storage capacitor, thereby enabling the pixel 122 to emit light with the desired amount of luminance during an emission operation following the programming operation. For example, the storage device in the pixel 122 can be charged during a programming operation to apply a voltage to one or more of a gate or a source terminal of the driving transistor during the emission operation, thereby causing the driving transistor to convey the driving current through the light emitting device according to the voltage stored on the storage device.

Generally, in the pixel 122, the driving current that is conveyed through the light emitting device by the driving transistor during the emission operation of the pixel 122 is a current that is supplied by the supply line 126*j*. The supply line 126*j* can provide a positive supply voltage (e.g., the voltage commonly referred to in circuit design as "VDD").

The display system 100 also includes a readout circuit 115 which is integrated with the source driver 114. With reference again to the top left pixel 122 in the display panel 120, the data line 123*j* connects the pixel 122 to the readout circuit 115. The data line 123*j* allows the readout circuit 115 to measure a current associated with the pixel 122 and hereby extract information indicative of a degradation of the pixel 122. Readout circuit 115 converts the associated current to a corresponding voltage. This voltage is converted into a 10 to 16 bit digital code and is sent to the digital control 116 for further processing or compensation.

Figure 7:
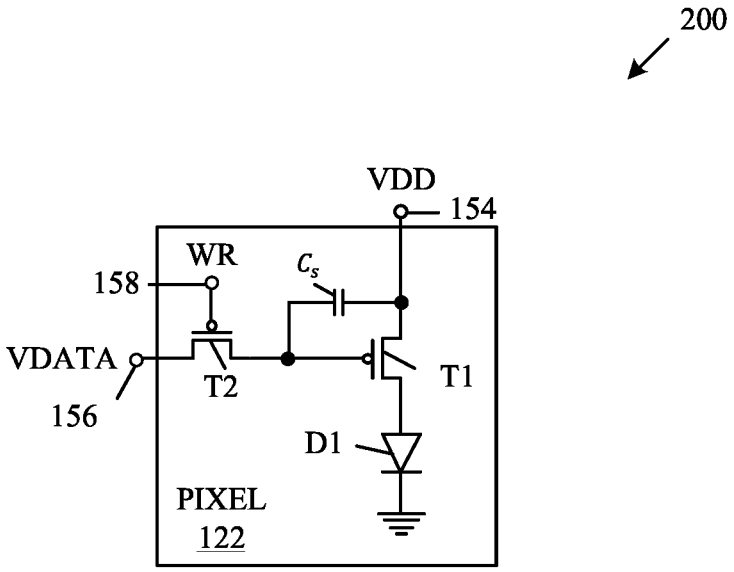
FIG. 7 is a block diagram of an embodiment of a pixel circuit which includes two TFTs, T1 and T2, an OLED and a capacitor.

FIG. 7 is a circuit diagram of a simple individual driver circuit 200 which contains a pixel 122 which is connected to supply voltage VDD 154, a data voltage VDATA 156 and is controlled by the write WR signal 158. The pixel 122 in FIG. 2 includes a switch transistor T2, a drive transistor T1 coupled to an organic light emitting device (OLED) D1, the switch transistor T2 and a storage capacitor $C_s$ for storing programming information and allowing the pixel circuit 122 to drive the light emitting device after being addressed. In FIG. 7, when the write WR signal 158 goes low, it enables the transistor T2 and the VDATA 156 is stored on the capacitor $C_s$. The Vgs (gate to source) voltage of the drive transistor T1 which is stored on the capacitor $C_s$ is equal to:

$$Vgs = VDATA - VDD$$

As explained above, each pixel 122 in the display panel 120 in FIG. 6 is driven by the method shown in the driver circuit 200 in FIG. 7. The driver circuit 200 includes a switch transistor T2, a drive transistor T1 coupled to an organic light emitting device (OLED) D1, a storage capacitor $C_s$ for storing programming information. VDATA 156 voltage comes from the source driver 114 and is stored on the capacitor $C_s$. The switch transistor T2 is controlled by WR 58 signal. In this example, the organic light emitting device (OLED) D1 is a luminous organic material which is activated by current flow and whose brightness is a function of the magnitude of the current. A supply voltage input 154 is coupled to the source (or drain) of the drive transistor T1. The supply voltage input 154 in conjunction with the drive transistor T1 supplies current to the light emitting device D1. The current level may be controlled via the source driver 114 in FIG. 6 and can be determined by the following formula:

$$I_{Pixel} = \frac{1}{2}k(VDATA - VDD - V_{th})^2$$

Where k depends on the size of the drive transistor T1 and $V_{th}$ is the threshold voltage of the drive transistor T1. In one example, the drive transistor T1 is a thin film transistor fabricated from hydrogenated amorphous silicon. In another example, low-temperature polycrystalline-silicon thin-film transistor ("LTPS-TFT") technology can also be used. Other circuit components such as capacitors and transistors (not shown) may be added to the simple driver circuit 200 to allow the pixel to operate with various enable, select and control signals such as those input by the gate driver 112 in FIG. 6. Such components are used for faster programming of the pixels, holding the programming of the pixel during different frames and other functions.

When the pixel 122 is required to have a defined brightness in applications, the gate of the drive transistor T1 is charged to a voltage where the transistor T1 generates a corresponding current to flow through the organic light emitting device (OLED) D1, creating the required brightness. The voltage at the gate of the transistor T1 can be either created by direct charging of the node with a voltage or self-adjusted with an external current.

During the programming mode, rows of pixels 122 are selected on a row by row basis. For example, the "ith" row of pixels 122 are selected and enabled by the gate driver 112, in which the WR signal line 144*i* is set to zero, i.e. WR=0. All pixels 122 in the "ith" row are connected to the source driver 114, such that the MEAS signal line 142 is set to VDD, i.e. MEAS=VDD, and the PE signal line 140 is set to equal 0, i.e. PE=0, for the "ith" row. The data VDATA (123*j* and 123*m*) as a voltage (or can be a current) is stored on the capacitors $C_s$ inside pixels 122. This data generates a Vgs voltage in T1 transistor which is stored in $C_s$ capacitor. When the pixel is in operational mode and is connected VDD, the voltage stored in $C_s$ capacitor generated a current in T1 transistor which is equal to:

$$I_{Pixel} = \frac{1}{2}k(VDATA - VDD - V_{th})^2$$

Pixel current, $I_{Pixel}$, flows into pixel 122 and OLED D1 has a luminance correspondence to the Pixel current.

Figure 8:
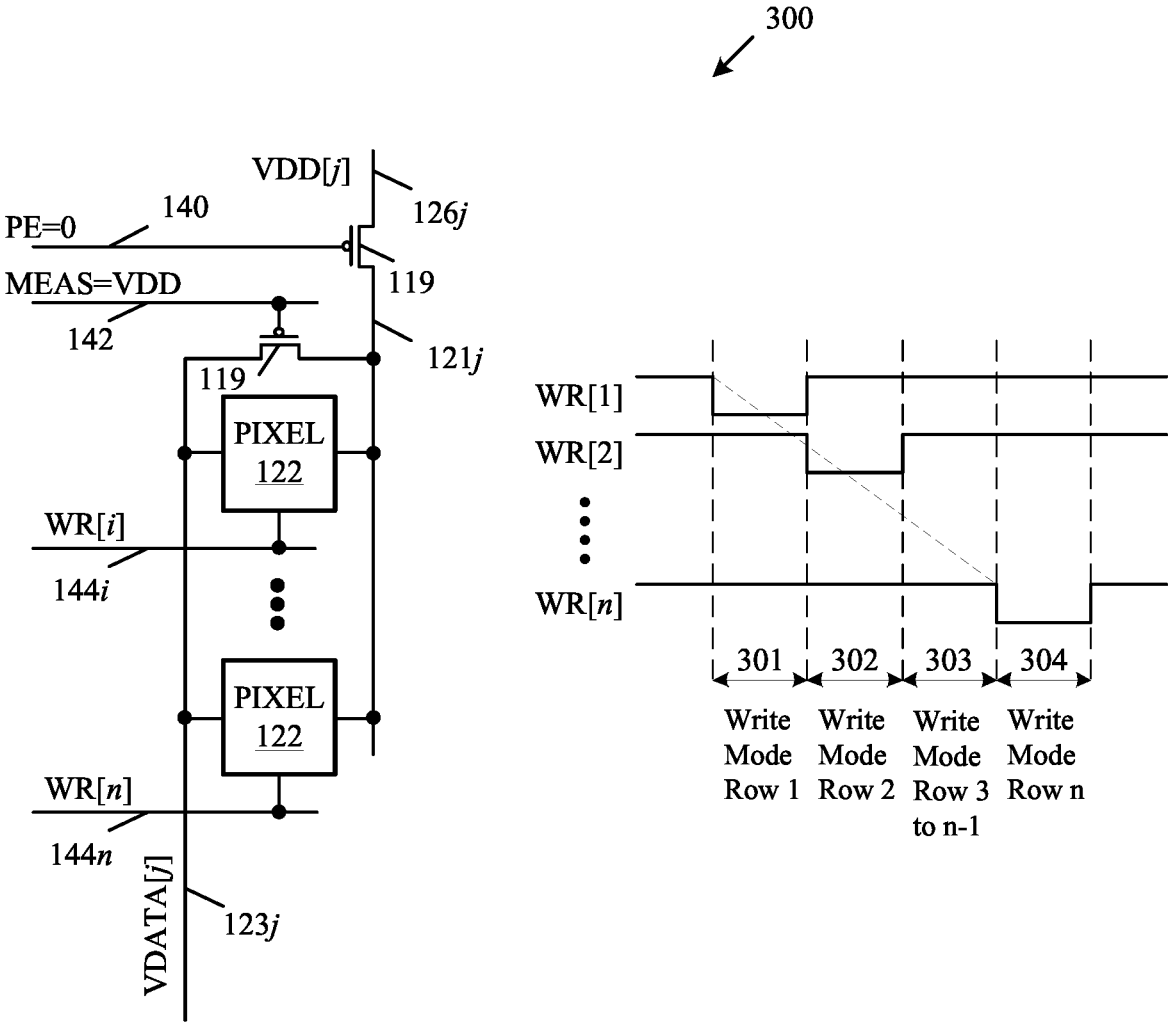
FIG. 8 is a block diagram of an embodiment of a column of pixel circuit ("jth" column) in programming mode.

FIG. 8 is a block diagram of an embodiment of a column of pixel circuit ("jth" column) 300 in programming modes. During the this mode, each row of the circuit 300 are selected on a row by row basis and enabled by the gate driver 112 in which the WR signal line 144*i* is set to zero, i.e. WR=0, and all pixels 122 are connected to the source driver 114 and the supply voltage VDD. The MEAS signal line 142 is set to VDD, i.e. MEAS=VDD, and the PE signal line 140 is set to equal 0, i.e. PE=0, as described in FIG. 8. In the first write mode 301, the write signal WR[1] is set to zero, i.e. WR[1]=0, and the row 1 is connected to the source driver 114 and the data VDATA[j] 123*j* is stored in capacitor $C_s$ in pixel in the row 1 and the "jth" column. In the second write mode 302, the write signal WR[2] is set to zero, i.e. WR[2]=0, and the row 2 is connected to the source driver 114 and the data VDATA[j] 123*j* is stored in capacitor $C_s$ in pixel in the row 2 and the "jth" column. In the third write mode 303, the write signal WR[i] (i=3 to n−1) is set to zero one by one, i.e. WR[i]=0 (i=3 to n−1), and the row i (i=3 to n−1) is connected to the source driver 114 one by one and the data VDATA[j] 123*j* is stored in capacitor $C_s$ in pixel in the "ith" row and the "jth" column. In the fourth write mode 304, the write signal WR[n] is set to zero, i.e. WR[n]=0, and the row n is connected to the source driver 114 and the data VDATA[j] 123*j* is stored in capacitor $C_s$ in pixel in the row n and the "jth" column.

In order to measure the pixel current, in the first step, all data line VDATA (123*j* and 123*m*) are set to have the same voltage as supply voltage (VDD) and all write signal WR (144*i* and 144*n*) are set to zero, i.e. WR[i]=0 (1=1 to n), then all capacitors' voltages inside pixel 122 will be zero and OLED devices D1 show black color. In the second step, the leakage current is measured. In the third step, the data is programmed on the row i. Finally, the row i is selected and the pixel current is measured.

Figure 9:
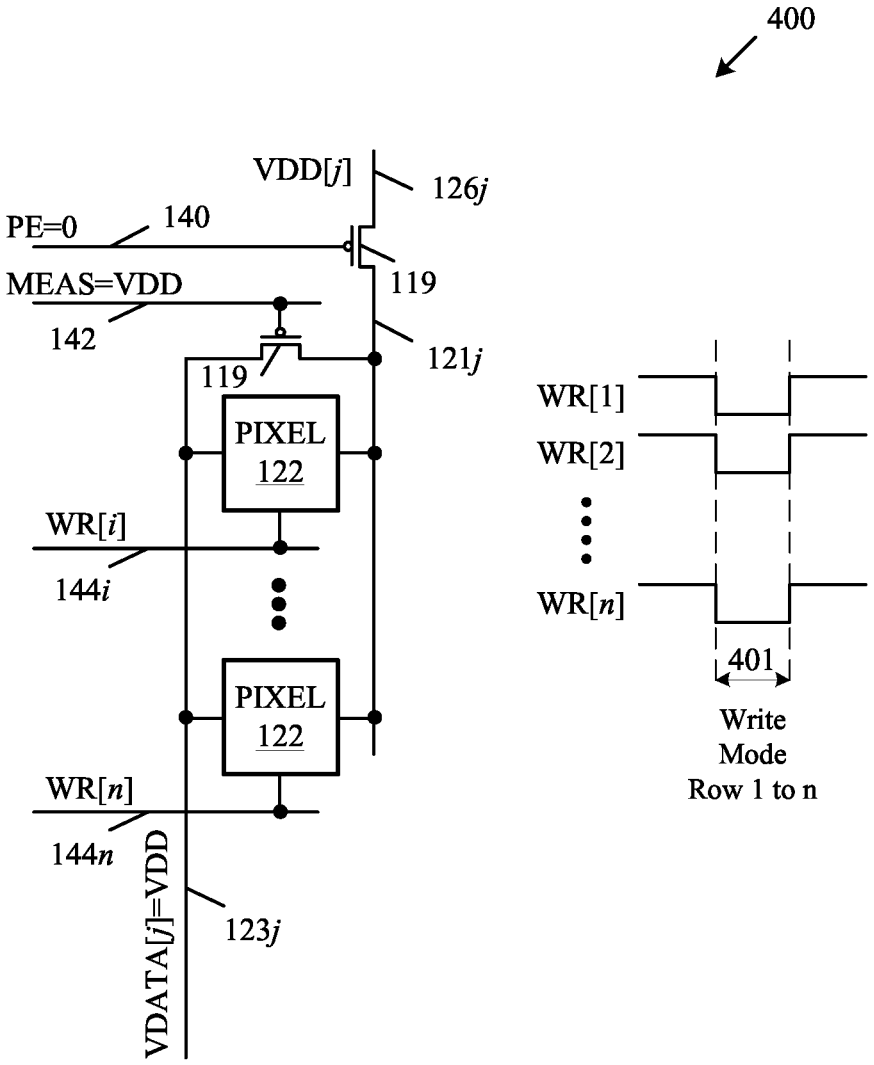
FIG. 9 is a block diagram of an embodiment of a column of pixel circuit ("jth" column). In this mode, data line has the same voltage as supply voltage (VDD) and all capacitors' voltages are set to be zero and OLED devices show black color.

FIG. 9 is a block diagram of an embodiment of a column of pixel circuit ("jth" column) 400 in programming mode. In first step, data line VDATA 123*j* has the same voltage as supply voltage VDD 126*j*. All write signals WR (144*i*, 144*n*) are set to zero, i.e. WR=0, and the MEAS signal line 142 is set to VDD, i.e. MEAS=VDD, and the PE signal line 140 is set to equal 0, i.e. PE=0, as described in FIG. 9. All pixels 122 in the circuit 400 are in write mode 401. All capacitors' voltages are set to zero and OLED devices D1 show black color. Alternatively all of the pixels can be driven to black one at a time sequentially similar to how the video is driven onto the panel.

Figure 10:
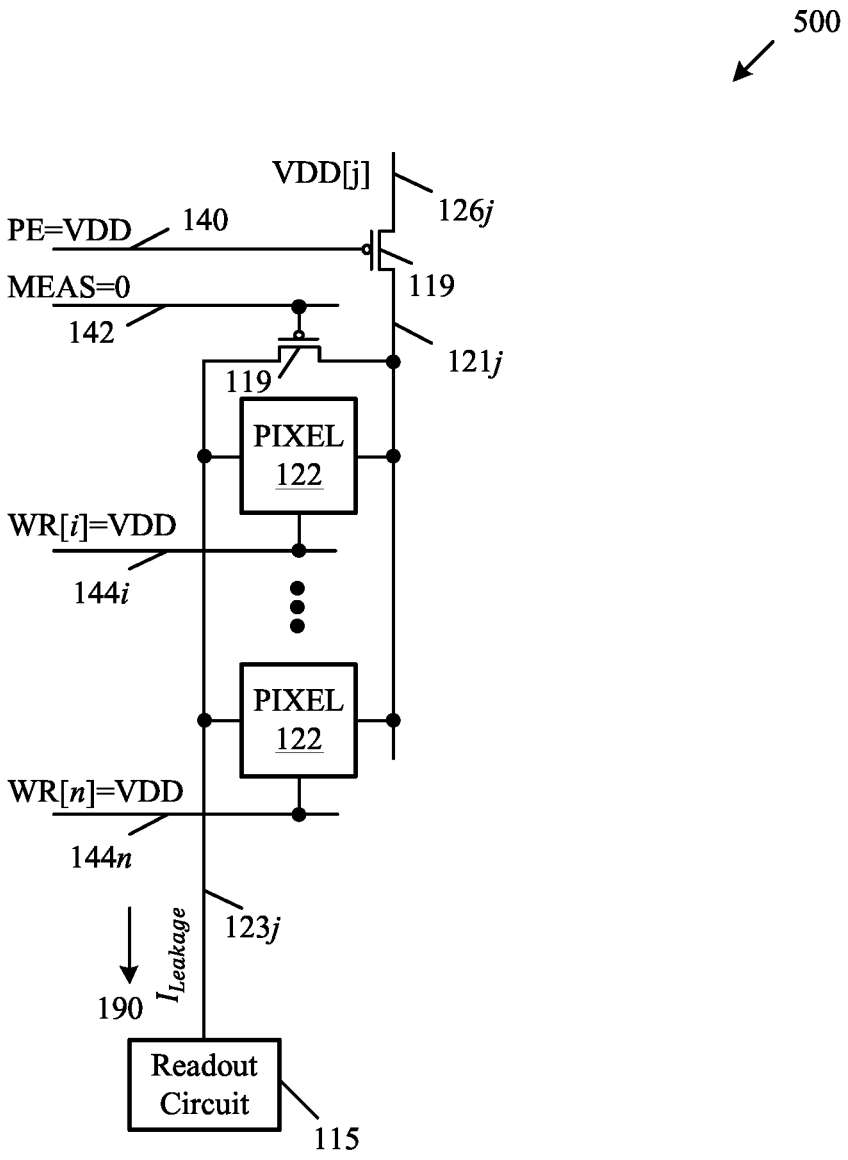
FIG. 10 is a block diagram of an embodiment of a column of pixel circuit ("jth" column) in measurement mode. The leakage current is measured in this mode.

FIG. 10 is a block diagram of an embodiment of a column of pixel circuit ("jth" column) 500 in measurement mode. In the second step, the leakage current is measured immediately after setting the capacitors' voltages of all pixels in the circuit 500 to zero. The WR signal line (144*i* and 144*n*) is set to VDD, i.e. WR=VDD, and the MEAS signal line 142 is set to 0, i.e. MEAS=0, and the PE signal line 140 is set to equal VDD, i.e. PE=VDD, as described in FIG. 10. The circuit 500 is disconnected from the supply voltage and connected to the data line, VDATA 123*j*. The leakage current of the pixels 122 in "jth" column (the circuit 500), $I_{Leakage}$ 190 flows into the source driver 114 and is measured by a Readout Circuit (ROC) 115. The ROC 115 measures the leakage current ($I_{Leakage}$) 190 and converts it to a correspondence voltage. This voltage is converted to 10 to 16 bit digital code and is sent to digital processor to be used for further processing or compensation.

Figure 11:
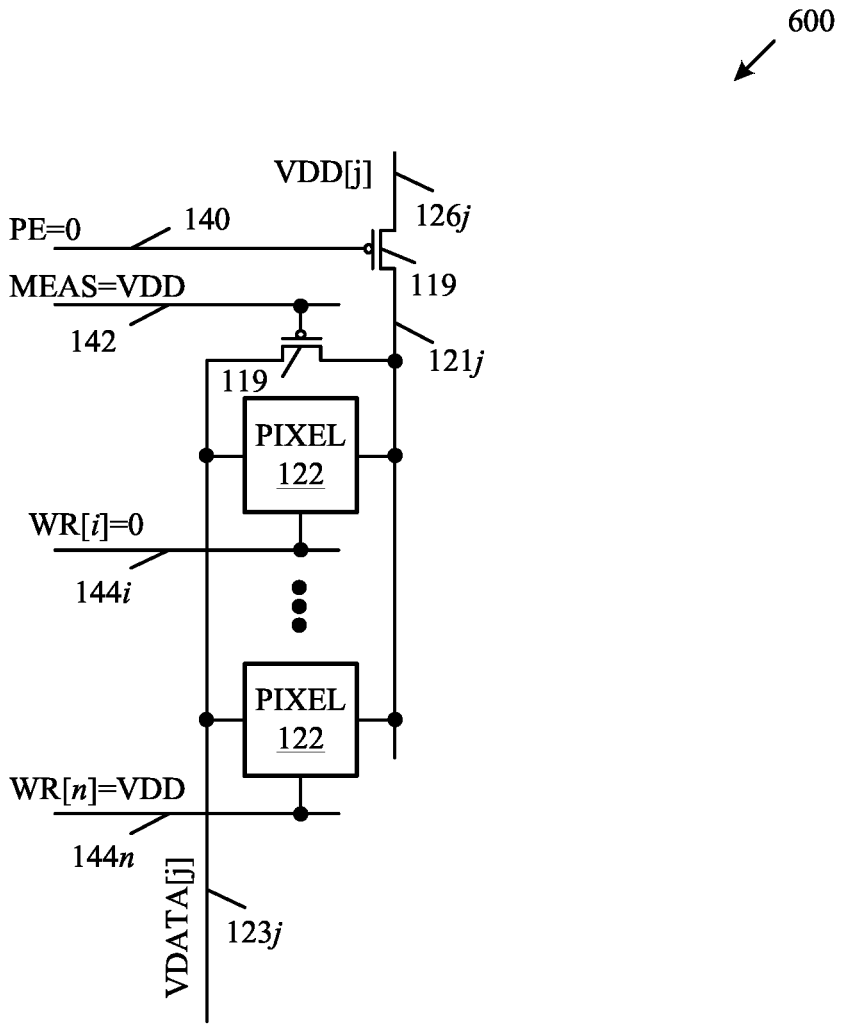
FIG. 11 is a block diagram of an embodiment of a column of pixel circuit ("jth" column) in programming mode. In this mode the "ith" row is programmed.

The third step is to write a data into the pixel which is of interested to measure its current. FIG. 11 is a block diagram of an embodiment of a column of pixel circuit ("jth" column) 600 in programming mode. In this mode the "ith" row is programmed. The WR signal line 144*i* is set to zero, i.e. WR[i]=0, and other WR signal lines 144*n* are set to equal VDD, i.e. WR[n]=VDD, and the MEAS signal line 142 is set to equal VDD, i.e. MEAS=VDD, and the PE signal line 140 is set to zero, i.e. PE=0, as described in FIG. 11. The pixel 122 in "ith" row is programmed to VDATA 123*j* and a current corresponded to it flows into the pixel. No current except for the leakage current flow into other pixel 122 in "jth" column.

Figure 12:
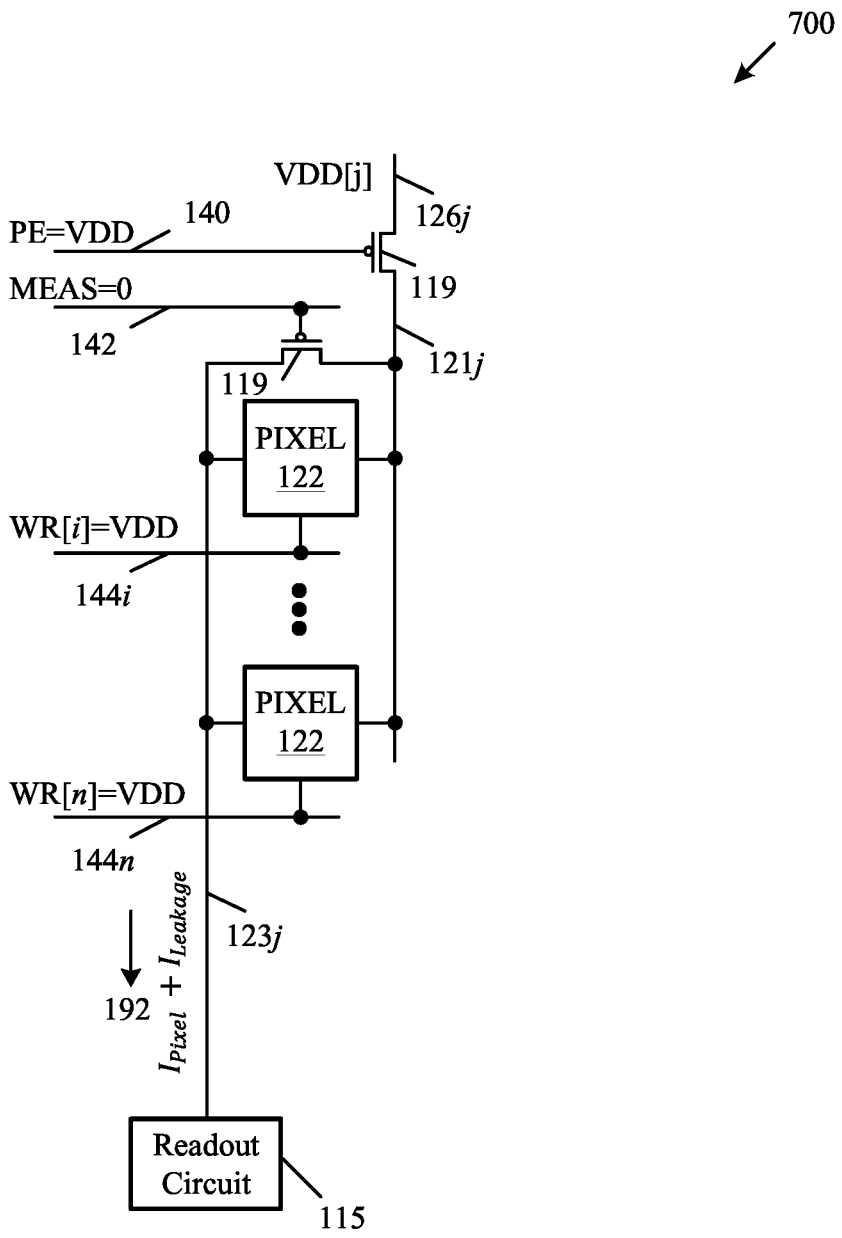
FIG. 12 is a block diagram of an embodiment of a column of pixel circuit ("jth" column) in measurement mode. The pixel current of the "ith" pixel plus the leakage currents of the other pixels are measured in this mode.

The last step is to measure the pixel current of the "ith" row. FIG. 12 is a block diagram of an embodiment of a column of pixel circuit ("jth" column) 700 in measurement mode. The pixel current of the "ith" row plus the leakage current of the other pixels are measured in this mode. The WR signal line (144*i* and 144*n*) is set to VDD, i.e. WR=VDD, and the MEAS signal line 142 is set to 0, i.e. MEAS=0, and the PE signal line 140 is set to equal VDD, i.e. PE=VDD, as described in FIG. 12. The circuit 700 is disconnected from the supply voltage and connected to the data line, VDATA 123*j*. The pixel current of the "ith" row plus the leakage current of other pixels in "jth" column (the circuit 700), $I_{pixel}+I_{Leakage}$, 192 flows into the source driver 114 and is measured by a ROC 115. The ROC 115 measures the current 192 and converts it to a correspondence voltage. This voltage is converted to 10 to 16 bit digital code. The difference between the current measured in the last step and the leakage current in the step two, is the pixel current of the "ith" row pixel in "jth" column circuit 700 according to the following formula:

$$I_{Pixel}=(\text{current measured in step 4})-(\text{current measured in step 2})$$

$$I_{Pixel}=(I_{Pixel}+I_{Leakage})-(I_{Leakage})$$

In order to measure the OLED current, all four steps described to measure the pixel current are repeated here. In the step one as shown in FIG. 9, the data line is set to equal VDD and the capacitors' voltages inside pixels are set to zero. In the step two as shown in FIG. 10, the leakage current, $I_{Leakage}$, 190 of the pixels is measured. In the step three as shown in FIG. 11, the "ith" row is selected and the data line VDATA 123*j* is derived with lowest voltage. It causes the T1 transistor inside the "ith" pixel 122 is pushed to the triode region and behaves like a switch. In the step four as shown in FIG. 8, the OLED D1 of the "ith" pixel 122 is connected to virtual ground 806 of an integrator 810 through the T1 transistor inside the "ith" pixel 122 and the transistor 119 connected between the pixel supply voltage node 121*j* and the data line 123*j* and the switch 807 inside the ROC 115. By ignoring the voltage drop on the switches, the OLED D1 of the "ith" pixel 122 will have the same voltage as the bias voltage $V_B$ 805. The OLED current of the "ith" row pixel plus the leakage current of other pixels in "jth" column (the circuit 800), $I_{Oled}+I_{Leakage}$, 194 flows into the source driver 114 and is measured by a ROC 115. The ROC 115 measures the current 194 and converts it to a correspondence voltage. This voltage is converted to 10 to 16 bit digital code 802. The difference between the current measured in the step four and the leakage current in the step two, is the OLED current of the "ith" row pixel in "jth" column circuit 800 according to the following formula:

$$I_{Oled}=(\text{current measured in step 4})-(\text{current measured in step 2})$$

$$I_{Oled}=(I_{Oled}+I_{Leakage})-(I_{Leakage})$$

Figure 13:
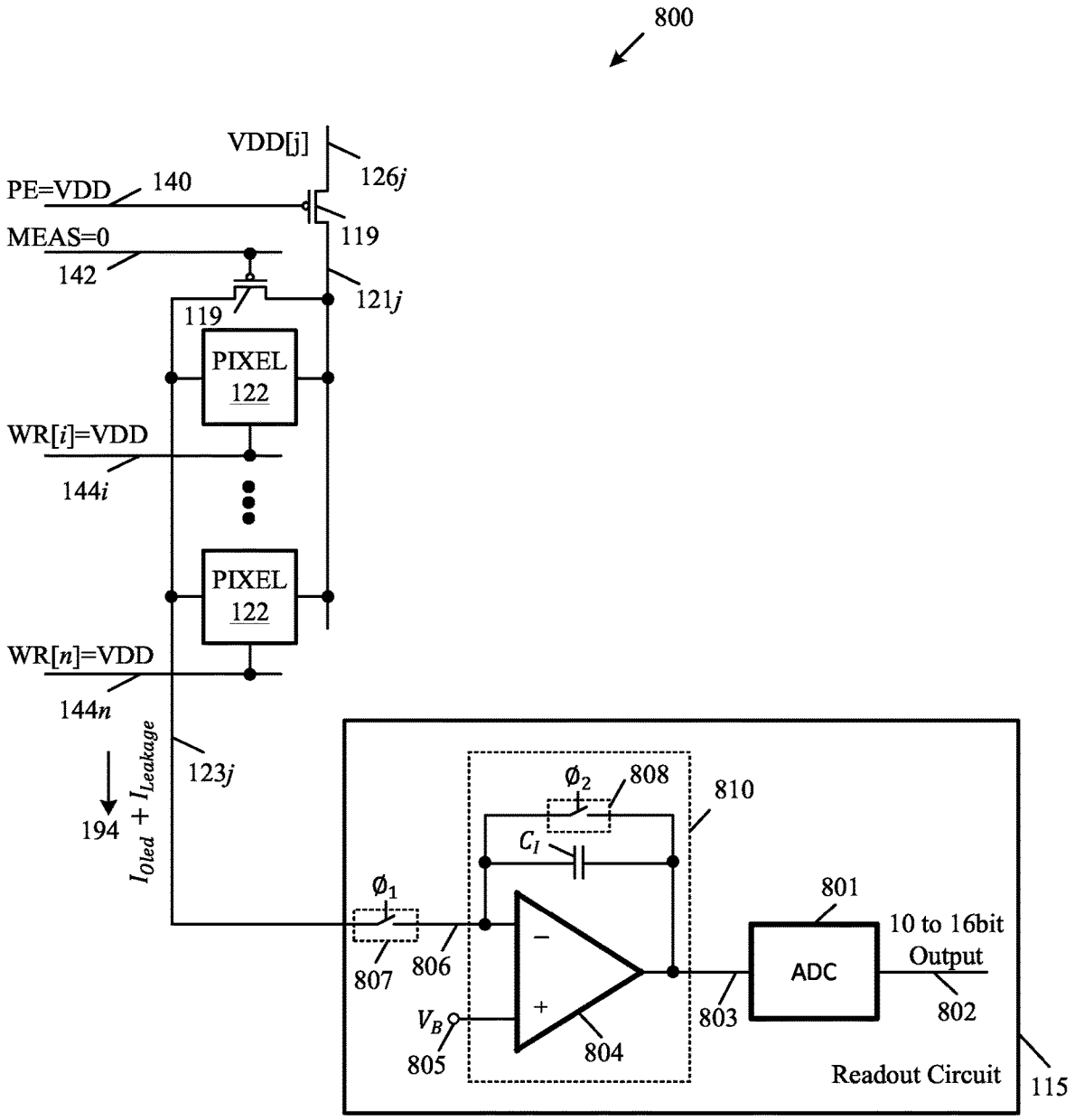
FIG. 13 is a block diagram of an embodiment of a column of pixel circuit ("jth" column) in measurement mode. The OLED current of the "ith" pixel plus the leakage currents of the other pixels are measured in this mode.

The ROC 115 as shown in FIG. 13 includes one switch 807, an integrator 810 and an analog to digital converter (ADC) 801. The integrator includes a reset switch 808, an integrating capacitor $C_I$ and a bias voltage $V_B$ 805. The integrator integrates the current coming from pixel 122 and converts it to a corresponding voltage. The voltage is converted to 10 to 16 bit digital code 802 by the ADC 801.

While particular embodiments and applications of the present invention have been illustrated and described, it is to be understood that the invention is not limited to the precise construction and compositions disclosed herein and that various modifications, changes, and variations can be apparent from the foregoing descriptions without departing from the spirit and scope of the invention as defined in the appended claims.

The invention claimed is:

1. A method of driving a plurality of pixels of a display system, the method comprising:

providing a supply voltage from a voltage supply to a first pixel of the plurality of pixels, during at least a first mode of operation, via a pixel supply voltage node coupled in series with and between the first pixel and the voltage supply, and coupled in series with and between the first pixel and a data line; and measuring a current from the first pixel, during a second mode of operation, via the pixel supply voltage node and over the data line.

2. The method of claim 1, further comprising:

providing a pixel data signal to the first pixel, during a third mode of operation, via the data line.

3. The method of claim 2, further comprising:

providing the supply voltage to the first pixel, during the third mode of operation, via the pixel supply voltage node.

4. The method of claim 2, wherein the at least the first mode of operation during which the supply voltage is provided to the first pixel via the pixel supply voltage node, includes an emission operation, and wherein the third mode of operation during which the pixel data signal is provided to the first pixel via the data line, includes a programming operation.

5. The method of claim 1, wherein the at least a first mode of operation during which the supply voltage is provided to the first pixel via the pixel supply voltage node, includes an emission operation.

6. The method of claim 1, wherein providing the providing the supply voltage to the first pixel during the at least the first mode of operation comprises controlling a first transistor switch coupled between a voltage supply providing the supply voltage and the pixel supply voltage node.

7. The method of claim 1, wherein measuring the current from the first pixel, during the second mode of operation comprises controlling a first transistor switch coupled between the voltage supply providing the supply voltage and the pixel supply voltage node and controlling a second transistor switch coupled between a source driver and the first pixel.

8. The method of claim 1, wherein the pixel supply voltage node comprises a voltage supply line.

9. The method of claim 8, wherein the voltage supply line is coupled to multiple of said pixels of said plurality of pixels.

10. The method of claim 1, wherein the pixel supply voltage node is coupled between the data line and the supply voltage.

11. A display system comprising:

a voltage supply;

one or more drivers;

a plurality of pixels including a first pixel, the first pixel couplable via a pixel supply voltage node to the voltage supply, and couplable via a data line to the one or more drivers, the pixel supply voltage node coupled in series with and between the first pixel and the voltage supply, and coupled in series with and between the first pixel and the data line;

a controller adapted to control the plurality of pixels, the voltage supply, and the one or more drivers to:

provide a supply voltage provided by the voltage supply to the first pixel, during at least a first mode of operation, via the pixel supply voltage node; and measure a current from the first pixel, during a second mode of operation, via the pixel supply voltage node and over the data line.

12. The display system of claim 11, wherein the controller is further adapted to:

provide a pixel data signal to the first pixel, during a third mode of operation, via the data line.

13. The display system of claim 12, wherein the controller is further adapted to:

provide the supply voltage to the first pixel, during the third mode of operation, via the pixel supply voltage node.

14. The display system of claim 12, wherein the at least the first mode of operation during which the supply voltage is provided to the first pixel via the pixel supply voltage node, includes an emission operation, and wherein the third mode of operation during which the pixel data signal is provided to the first pixel via the data line, includes a programming operation.

15. The display system of claim 11, wherein the at least the first mode of operation during which the supply voltage is provided to the first pixel via the pixel supply voltage node, includes an emission operation.

16. The display system of claim 11, further comprising a first transistor switch coupled between the voltage supply and the pixel supply voltage node, wherein providing the supply voltage to the first pixel during the at least the first mode of operation comprises controlling the first transistor.

17. The display system of claim 11, further comprising a first transistor switch coupled between the voltage supply and the pixel supply voltage node and a second transistor switch coupled between a source driver of the one or more drivers and the first pixel, wherein measuring the current from the first pixel, during the second mode of operation comprises controlling the first transistor switch and controlling the second transistor switch.

18. The display system of claim 11, wherein the pixel supply voltage node comprises a voltage supply line.

19. The display system of claim 18, wherein the voltage supply line is coupled to multiple of said pixels of said plurality of pixels.

20. The display system of claim 11, wherein the pixel supply voltage node is coupled between the data line and the supply voltage.

* * * * *